US011369540B2

(12) United States Patent
Carr

(10) Patent No.: US 11,369,540 B2
(45) Date of Patent: Jun. 28, 2022

(54) PELVIC MASSAGE DEVICE AND METHOD OF USE

(71) Applicant: Daniel Edward Carr, Los Angeles, CA (US)

(72) Inventor: Daniel Edward Carr, Los Angeles, CA (US)

( * ) Notice: Subject to any disclaimer, the term of this patent is extended or adjusted under 35 U.S.C. 154(b) by 0 days.

(21) Appl. No.: 17/147,331

(22) Filed: Jan. 12, 2021

(65) Prior Publication Data

US 2021/0236372 A1 Aug. 5, 2021

Related U.S. Application Data

(63) Continuation-in-part of application No. 16/778,788, filed on Jan. 31, 2020, now Pat. No. 1,112,351.

(51) Int. Cl.
*A61H 15/00* (2006.01)
*A61H 1/00* (2006.01)

(52) U.S. Cl.
CPC ..... *A61H 1/008* (2013.01); *A61H 2201/1253* (2013.01); *A61H 2201/1628* (2013.01); *A61H 2201/1671* (2013.01); *A61H 2201/1676* (2013.01); *A61H 2201/1695* (2013.01)

(58) Field of Classification Search
CPC ..... A61H 2201/081; A61H 2201/0192; A61H 2201/1284
USPC ..... 403/63
See application file for complete search history.

(56) References Cited

U.S. PATENT DOCUMENTS 1,984,520 A * 12/1934 Curtis ..... A61H 39/06 602/2
3,416,792 A * 12/1968 Morgan ..... A63B 22/16 482/146
3,511,500 A * 5/1970 Dunn ..... A63B 21/015 482/146
3,548,810 A * 12/1970 Hoyer ..... A61H 1/02 601/26
3,563,605 A * 2/1971 Pinkas ..... A47C 16/025 297/423.43
3,659,844 A * 5/1972 Cummins ..... A63B 21/023 482/106
3,784,148 A * 1/1974 Hill ..... A47C 3/025 248/596
3,831,592 A * 8/1974 Lancellotti ..... A61H 39/04 601/135
3,901,222 A * 8/1975 Muramatsu ..... A61H 1/00 606/240
4,352,491 A * 10/1982 Bellia ..... A63B 23/0233 482/142
4,520,798 A * 6/1985 Lewis ..... A61H 39/04 601/134
4,771,493 A * 9/1988 Park ..... A47G 9/1009 5/603

(Continued)

*Primary Examiner* — Justine R Yu
*Assistant Examiner* — Christopher E Miller
(74) *Attorney, Agent, or Firm* — Cohen IP Law Group, PC; Michael N. Cohen

(57) ABSTRACT

A massage tool that provides direct therapeutic pressure to the ventral rami and femoral nerves, and/or the psoas and iliacus muscles is disclosed. The tool includes upward pointing blades that may be properly aligned with the nerves and/or muscles to gently lengthen the nerves and relax the muscles. This in turn may lessen pressure to associated joints and bones thereby providing relief to chronic back and/or leg pain.

19 Claims, 35 Drawing Sheets

(56) References Cited

U.S. PATENT DOCUMENTS 4,822,039 A * 4/1989 Gonzales ..... A63B 21/04 482/130
4,848,742 A * 7/1989 Lindley ..... A61H 1/0292 482/142
5,131,410 A * 7/1992 Neill ..... A61G 7/07 5/657
5,421,799 A * 6/1995 Rabin ..... A61H 7/006 2/410
5,755,651 A * 5/1998 Homyonfer ..... A63B 22/16 482/130
6,159,169 A * 12/2000 Lambden ..... A47G 9/10 5/637
6,171,273 B1 * 1/2001 Saunders ..... A61F 5/04 5/637
6,179,794 B1 * 1/2001 Burras ..... A61H 23/0263 601/46
6,217,488 B1 * 4/2001 Bernardson ..... A63B 23/03533 482/79
6,866,644 B1 * 3/2005 Kost ..... A61H 23/02 601/49
9,192,503 B1 * 11/2015 Peterson ..... A61H 1/0296
9,402,759 B2 * 8/2016 Bonutti ..... A61H 1/0288
10,675,215 B1 * 6/2020 Yoon ..... A61H 7/001
10,946,247 B1 * 3/2021 Burton ..... A63B 71/0054
2004/0000803 A1 * 1/2004 Guillot ..... A47C 1/0355 297/270.1
2004/0147959 A1 * 7/2004 Shin ..... A61H 39/04 606/240
2005/0101450 A1 * 5/2005 Gramaccioni ..... A63B 22/16 482/72
2005/0164836 A1 * 7/2005 Harker ..... A63B 22/205 482/52
2006/0241538 A1 * 10/2006 Chen ..... A61H 7/001 601/134
2007/0117698 A1 * 5/2007 Adamson ..... A61H 1/0296 482/148
2007/0276438 A1 * 11/2007 Meglin ..... A61H 7/001 606/237
2007/0298949 A1 * 12/2007 Soletski ..... A63B 22/16 482/146
2008/0086066 A1 * 4/2008 Munday ..... A61H 39/04 601/135
2009/0012435 A1 * 1/2009 Masek ..... A61H 39/04 601/128
2009/0218862 A1 * 9/2009 Du ..... A47C 3/027 297/265.1
2011/0263398 A1 * 10/2011 Klassen ..... A63B 22/18 482/146
2012/0059405 A1 * 3/2012 Reynolds ..... A61H 39/04 606/204
2012/0264579 A1 * 10/2012 Klein ..... A63B 22/18 482/146
2013/0204293 A1 * 8/2013 Sakakibara ..... A61H 39/04 606/204
2014/0259422 A1 * 9/2014 Cohen ..... A61H 15/00 5/636
2014/0378283 A1 * 12/2014 Qiu ..... A61H 1/0292 482/142
2015/0190679 A1 * 7/2015 Carbone ..... A63B 21/0004 482/146
2016/0279013 A1 * 9/2016 Bonutti ..... A61H 1/0296
2017/0252606 A1 * 9/2017 Ban ..... A63B 23/02
2017/0348175 A1 * 12/2017 Emmel ..... A61H 7/007
2018/0049938 A1 * 2/2018 Fleming ..... A61G 7/072
2018/0055722 A1 * 3/2018 Murnaghan ..... A61H 15/00
2018/0311102 A1 * 11/2018 Frankson ..... A63B 21/00185
2019/0343718 A1 * 11/2019 Shin ..... A47G 9/1045
2020/0086172 A1 * 3/2020 Tarkington ..... A63B 21/0085
2020/0297570 A1 * 9/2020 Lee ..... A61H 1/008
2021/0361999 A1 * 11/2021 Tarkington ..... A63B 22/16

* cited by examiner

PELVIC MASSAGE DEVICE AND METHOD OF USE

RELATIONSHIPS TO PRIOR APPLICATIONS

This application is a Continuation-in-Part to U.S. patent application Ser. No. 16/778,788, filed Jan. 31, 2019, the entire contents of which are hereby fully incorporated herein by reference for all purposes.

COPYRIGHT STATEMENT

This patent document contains material subject to copyright protection. The copyright owner has no objection to the reproduction of this patent document or any related materials in the files of the United States Patent and Trademark Office, but otherwise reserves all copyrights whatsoever.

FIELD OF THE INVENTION

This invention relates to massage tools, including a manual massage tool with blades.

BACKGROUND

Lower back pain is a chronic condition that afflicts millions of people throughout the world. In many cases, the lower back pain is caused by an injury to anatomical structures, i.e., nerves and muscles, associated with the lumbar vertebrae (e.g., L1, L2, L3, L4, L5) of the spine, causing the vertebrae to become compressed and misaligned, discs to bulge, and/or subsequent impingement on adjacent spinal nerves, i.e. sciatica. These spinal nerve impingements can cause nerve radiation and muscle spasming in the low back, hips, and legs and subsequent chronic pain of the low back, hips, knees, and ankles.

These types of injuries can be greatly exasperated by an accompanying contraction and spasm of the ventral rami of the lumbar plexus L1-L4, femoral nerve and/or the lateral femoral cutaneous nerve, which in turn involuntarily contracts the psoas and/or iliacus muscles into spasm. The resulting spasming and/or permanent contractions of these muscles further compresses the distance between the lumbar vertebrae, causing increased misalignment and bulging of the discs and/or nerve radiation. Scar tissue adhesions forming on the psoas and/or iliacus muscles can directly adhere to the ventral rami of the lumbar plexus L1-L4, the femoral nerve and/or the lateral femoral cutaneous nerve and thereby solidify the anatomical structure of these contractions of the ventral rami of the lumbar plexus L1-L4, the femoral nerve and/or lateral femoral cutaneous nerve into a permanent ongoing spasm, which in turn results in chronic back pain, hip pain, and/or knee pain for the sufferer.

The common procedures that attempt to remedy the misaligned and/or bulging vertebrae, compressed hips, and/or knee compression can involve invasive back surgery, hip surgery, and/or knee surgery that is known to often cause further health and chronic pain issues.

In addition, massage therapy and/or physical therapy are relatively ineffective in treating disorders of the psoas, iliacus, ventral rami of the lumbar plexus L1-L4, femoral nerves, and/or lateral femoral cutaneous nerves due to the inaccessibility of these anatomical structures. Most practitioners lack the skill and/or the strength to penetrate through the abdominal wall to properly manipulate these structures. Chiropractic adjustments without skillful massage manipulation are ineffective as well, typically causing further spasming in muscles resistant to the motion of the adjustment.

However, by directly manipulating spasming ventral rami of the lumbar plexus L1-L4, femoral nerves and/or lateral femoral cutaneous nerves, as well as scar tissue adhesion laden psoas and/or iliacus muscles, the nerves may be re-lengthened, the muscles may be relaxed out of spasm, and the scar tissue adhesions can be repaired. Subsequently, muscular compression will be released from upon the lumbar vertebrae, thereby relieving the pressure on bulging discs and their impingement on adjacent spinal nerves.

Accordingly, there is a need for a massage tool that provides relief to misaligned vertebrae, bulging discs, and/or impinged nerves by applying cross-fiber pressure to the ventral rami of the lumbar plexus L1-L4, femoral nerves and the psoas muscles, as well as deep tissue pressure to the lateral femoral cutaneous nerves and iliacus muscles.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

Figure 1:
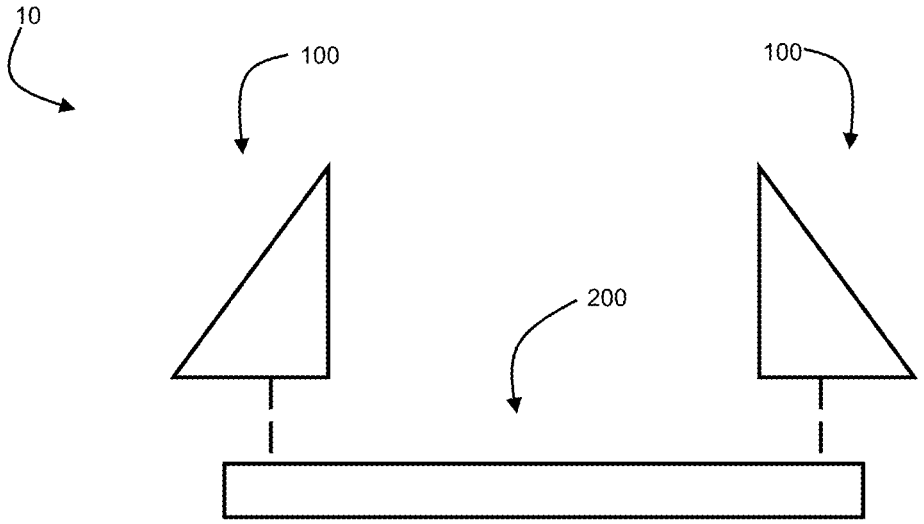
FIGS. 1-2 show aspects of a massage device according to exemplary embodiments hereof.

In general, the device and method according to exemplary embodiments hereof includes a massage tool for the manipulation of bodily tissues and nerves for therapeutic and/or relaxation purposes, and the tool's method of use thereof.

In some embodiments, the device includes a massage tool with one or more massage blades or wedges. In some embodiments, the blades are shaped and specifically contoured to massage and eradicate scar tissue that may have accumulated on, around, and/or in between a patient's iliacus, psoas major, and/or psoas minor muscles, and/or on the ventral rami of the lumbar plexus L1-L4, the femoral nerve, the lateral femoral cutaneous nerve and/or their branches including the saphenous nerve.

In some embodiments, the tool includes two blades (e.g., a left blade and a right blade) for treating the patient's left and right psoas muscles, ventral rami of the lumbar plexus L1-L4, femoral nerves, lateral femoral cutaneous nerves, saphenous nerves, and/or iliacus muscles. In some embodiments, the tool may include a linkage between the left and right blades.

Further details of the device, as well as the device's methods of use will be described in detail below.

The following detailed description is not intended to limit the current invention. Alternate embodiments and variations of the subject matter described herein will be apparent to those skilled in the art.

Referring now to FIGS. 1-14, the device 10 according to exemplary embodiments hereof will be described in further detail. Where the same or similar components appear in more than one figure, they are identified by the same or similar reference numerals.

In one exemplary embodiment as shown in FIG. 1, the device 10 may include a blade assembly 100 and a linkage assembly 200. In general, the linkage assembly 200 may link two or more elements of the blade assembly 100. The connection(s) between the elements of the blade assembly 100 and the linkage assembly 200 are represented as dashed lines to indicate that the connections may vary the type of attachment and the attachment mechanisms used. Details of this will be described in other sections. The device 10 may include other elements and/or components that may be necessary for the device 10 to perform its desired functionalities as described in this specification.

Figure 2:
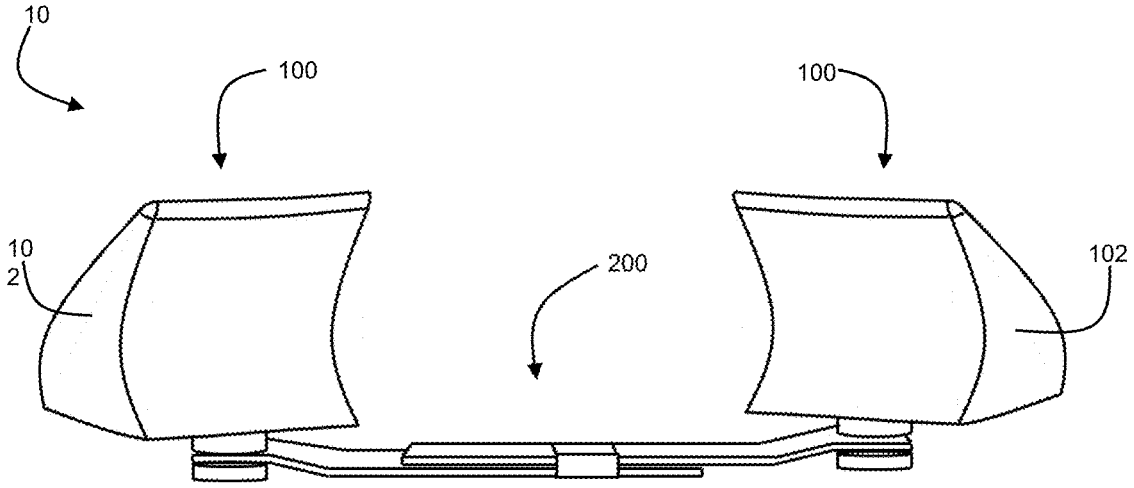

In some embodiments as shown in FIG. 2, the blade assembly 100 includes one, two or more blades 102. In one embodiment, the blade assembly 100 includes two blades 102 (e.g., a left blade 102-L and a right blade 102-R).

For the purposes of this specification, in some instances within this specification, a blade 102 may be described singularly with the understanding that descriptions of a single blade 102 also may apply to additional blades 102 of the blade assembly 100 as described in other sections.

Figure 3:
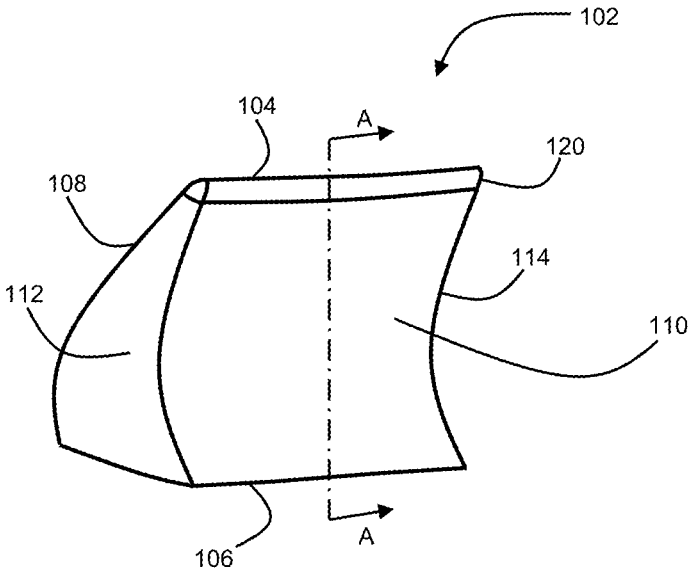
FIG. 3 shows aspects of a massage device blade according to exemplary embodiments hereof.

In some embodiments as shown in FIG. 3, the blade 102 includes a top side 104, a bottom 106 (also referred to as the base), a back side 108, a front side 110, a left side 112 and a right side 114. In general, several surfaces of the blade 102 may be adapted to contact the bodily tissues and nerves to be massaged. For example, the top side 104 and the back side 108 may be adapted for these purposes as will be described in other sections.

Figure 4:
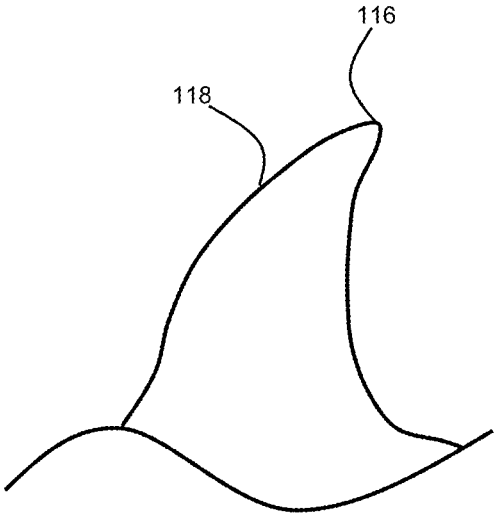
FIGS. 4, 4A-4I, and 5 show aspects of a massage device blade according to exemplary embodiments hereof.

In one exemplary embodiment hereof, the cross-sectional shape of the blade 102 looking in the direction of cut lines A-A resembles a "shark fin" or "killer whale fin" shape as shown in FIG. 4. In this embodiment, the top 104 includes a top ridge 116, the back 108 includes a sloping convex back surface 118 and the front 110 includes a sloping concave front surface 119. The upper tip 104 of the top ridge 116 may be generally rounded, sharp, squared (with a front and back edge), other shapes and any combination thereof. As will be described in other sections, the top ridge 116 may be used to apply cross-fiber pressure to the psoas muscles and/or the ventral rami (including the anterior rami) of the lumbar plexus L1-L4, femoral nerves, and saphenous nerves of the patient, and the convex back surface 118 may be used to apply deep tissue pressure to the iliacus muscle and/or lateral femoral cutaneous nerves.

Figure 4A:
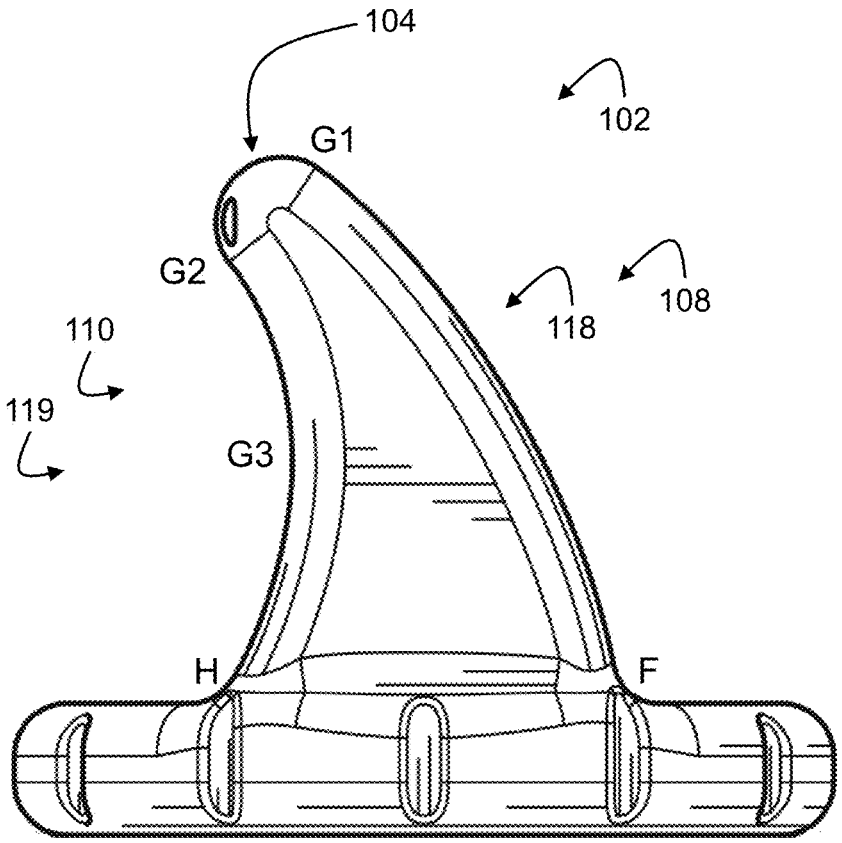

FIG. 4A shows a cross-sectional view of a blade 102 according to exemplary embodiments hereof. In some embodiments, the outer surface of the cross-section of the blade 102 is generally defined as the surface portion that extends from point F to point G1, from point G1 to point G2, and from point G2 to point H. The distal end of the blade 102 includes a tip 104 comprising the portion that extends from G1 to G2. The convex back surface 118 of the back side 108 also may be referred to as a "convex up" surface as known in the art because of its form, and the concave front surface 119 of the front side 110 also may be referred to as a "concave down" surface as known in the art because of its form.

In some embodiments, the outer surface of the cross-section of the blade 102 that extends from F to G1 (referred to herein as portion F-G1) includes a convex curvature arcing from F to G1 (e.g., a convex up surface), with a decreasing slope from F to G1. As such, the portion F-G1 includes a decreasing slope from F to G1. In some embodiments, the outer surface of the cross-section of the blade 102 that extends from H to G2 (referred to herein as portion H-G2) includes a concave curvature arcing from H to G (e.g., a concave down surface). As such, the portion H-G2 includes an increasing slope from H to an intermediate point G3 between points H and G2, and a decreasing negative slope from the intermediate point G3 to G2 (that is, the slope is negative and the absolute value of the slope transitions from a larger number to a smaller number from G3 to G2).

In some embodiments, the portions F-G1 and H-G2 may include partial parabolic curvatures. In some embodiments, the portions F-G and H-G2 include smooth arcing curvatures. In some embodiments, the portions F-G and H-G2 include converging linear portions angled accordingly.

In some embodiments, the tip 104 of the blade 102 may be generally rounded, pointed, and/or may include other cross-sectional shapes as described in other sections.

Figure 4B:
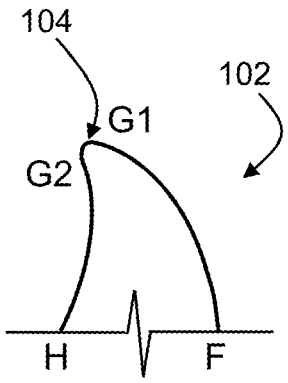
Figure 4C:
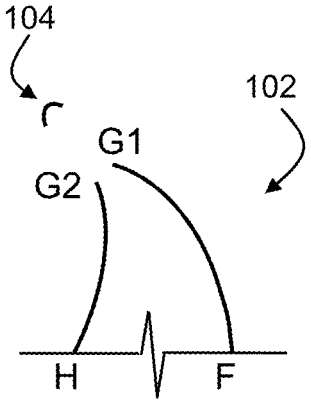

For clarity, FIG. 4B shows the blade 102 represented by portions F-G1, G1-G2, and G-H, and FIG. 4C shows the blade 102 with the tip portion 104 separated (illustratively) from the portions to clearly show the convex arcing curvature of portion F-G1 and the concave arcing curvature of portion H-G2. Note that in some embodiments, the length of portion F-G1 is greater than the length of portion H-G2. For example, the length of portion F-G1 may be about 5%-20% longer than the length of portion H-G2.

Figure 4D:
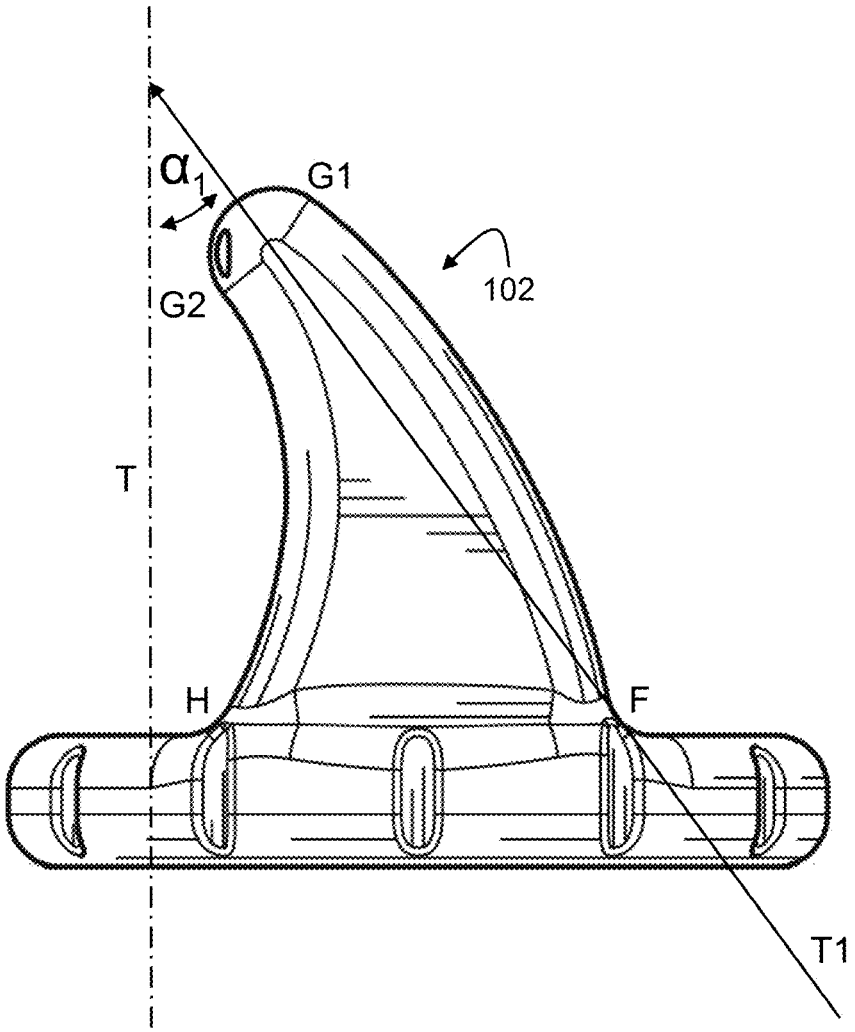

In another depiction as shown in FIG. 4D, vertical axis T is generally perpendicular with an axis passing through points H and F, and axis T1 passes through points F and an approximate midpoint between G1 and G2 of the blade 102 and forms an angle $\alpha_1$ with respect to the axis T. In this way, the blade 102 is generally angled to the left in its form (in the perspective of FIG. 4D) as shown. That is, the tip 104 of the blade 102 is angled to the left.

In some embodiments, $\alpha_1$ may range from 1°-89° and preferably from about 20°-60°.

In one exemplary embodiment hereof, the outer surface contour of the cross-section of the blade 102 is modeled as an Orca dorsal fin shape (viewed from the side). In some embodiments, the outer surface contour of the cross-section of the blade 102 is more specifically modeled as a dorsal fin shape (viewed from the side) of the Type 1 Eastern North Atlantic female (as shown in FIG. 4), the Offshore female, and/or the Type 2 Eastern North Atlantic female Killer Whales. In another embodiment, the outer surface contour of the cross-section of the blade 102 is more specifically modeled as a dorsal fin shape (viewed from the side) of the Bigg's female and/or the Resident female Killer whales. In other embodiments, the outer surface contour of the cross-section of the blade 102 may be modeled after other Orca ecotypes not mentioned here.

It is noted that in some embodiments the cross-sectional shapes of one or more blades 102 configured with the assembly 10 may match, while in other embodiments the cross-sectional shapes of the blades 102 may not match. In this case, each blade 102 may be modeled using a different ecotype and/or gender of Orca, and/or using different dimensions. In other cases, a first blade 102 may include an Orca-shaped cross-sectional shape while a second blade 102 may include a different cross-sectional shape. It is understood that the cross-sectional shapes of the blades 102 may include any combination thereof of any of the shapes described or otherwise.

Figure 4E:
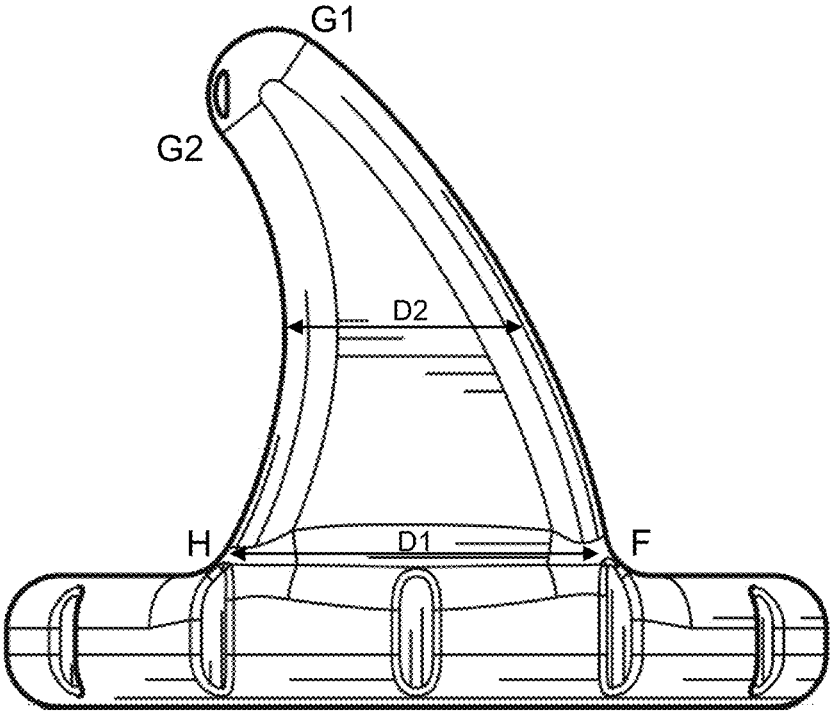

FIG. 4E shows a cross-sectional view of a blade 102 according to exemplary embodiments hereof. The base width D1 of the blade 102 (e.g., between F and H) is generally larger than the midpoint width D2 of the blade 102. In some embodiments, the blade 102 is tapered from their respective bases to their respective tips.

In some embodiments, the width D2 is about 60%-90% the width D1, and preferably about 80% the width of D1. In some embodiments the diameter of the tip at G is about 25%-75% the width D2, and preferably about 50% the width of D2. In other embodiments, the diameter of the tip at G is smaller and about 1%-25% the width of D2, and preferably about 5%-10% or about 6% the width of D2.

In some embodiments, D1 is about 0.25"-2" and preferably about 1.5", and D2 is about ⅛"-1.25" and preferably about 1".

In some embodiments, the tip 104 is rounded with a diameter of about 1/64"-⅝" and preferably about ¼".

It is understood that the dimensions shown above are meant for demonstration and that the measurements D1, D2, and the diameter of the tip's curvature may include other values as required by the device 10.

Figure 4F:
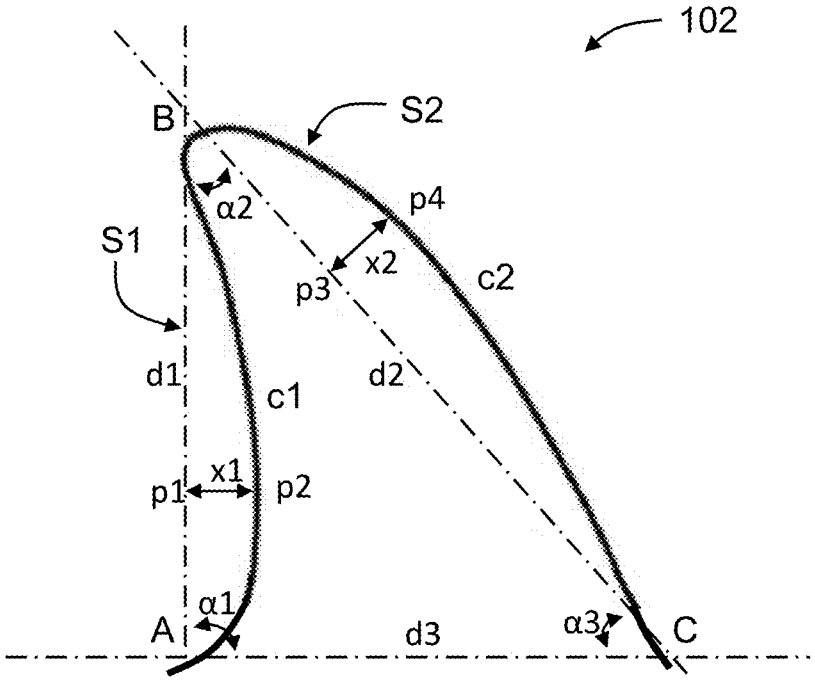

In one exemplary embodiment as shown in FIG. 4F, the cross-sectional shape of a blade 102 is defined with respect to its comparison with a right-angled triangle. FIG. 4F shows a right-angled triangle defined by the dashed lines extending between point A and point B (line d1), between point B and point C (line d2), and between point C and point A (line d3). For reference, this triangle will be referred to as triangle ABC. FIG. 4F also shows the cross-sectional shape of a blade 102 overlaid the triangle ABC.

In some embodiments, the cross-sectional shape of the blade 102 includes a first concave curvature c1 (defining its left side as shown in FIG. 4F) and a first convex curvature c2 (defining its right side as shown in FIG. 4F), with the top of first concave curvature c1 intersecting the top of the first convex curvature c2 at the ridge's top apex generally shown at point B. The tip 104 of the blade 102 may be located at this top apex. The bottom of the first concave curvature c1 intersects the base line of the blade 102 (line d3 that passes through points A and C) at point A. The bottom of the first convex curvature c2 intersects the base line of the blade 102 (line d3 that passes through points A and C) at point C. The resulting cross-sectional shape of the blade 102 thereby resembles an Orca dorsal fin.

As shown, the shape S1 is generally formed by the combination of line d1 and the curvature c1, and the shape S2 is generally formed by the combination of line d2 and the curvature c2. It can be seen that if the shape S1 were to be flipped vertically that the shape of shape S1 would resemble the shape of shape S2.

The arrow x1 represents the maximum perpendicular distance with respect to the line d1 between the line d1 and the curvature c1, and the arrow x2 represents the maximum perpendicular distance with respect to the line d2 between the line d2 and the curvature c2. The arrow x1 intersects the line d1 at the point p1 and the curvature at point p2. The arrow x2 intersects the line d2 at the point p3 and the curvature c2 at the point p4. The apex of the curvature c1 generally coincides with the point p2 and the apex of the curvature c2 generally coincides with the point p4.

Accordingly, the triangle ABC may be transformed into the cross-sectional shape of a blade 102 by removing the shape S1 from the triangle ABC, flipping the shape S1 vertically, and overlaying and aligning shape S1's line d1 onto line d2.

In some embodiments as shown in FIG. 4F, $\alpha 1$ equals about 90°, $\alpha 2$ equals about 30° and $\alpha 3$ equals about 60°. In some embodiments, x1 equals about (1/24)(d1) to about (3/24)(d1) and preferably about (1/12)(d1). In some embodiments, the distance between point B and the point p1 is about (5/12)(d1) to about (7/12)(d1) and preferably about (1/2)(d1).

In other embodiments, x1 equals about (1/12)(d1) to about (3/12)(d1) and preferably about (2/12)(d1). In some embodiments, the distance between point B and the point p1 is about (7/12)(d1) to about (9/12)(d1) and preferably about (8/12)(d1).

In some embodiments, x1=x2. In other embodiments, x1=(x2)±(0.1)(x2) to (x2)±(0.3)(x2).

It is understood that the examples described above are meant for demonstration and that the dimensions of the various elements of the blades 102 may include other values.

Figure 4G:
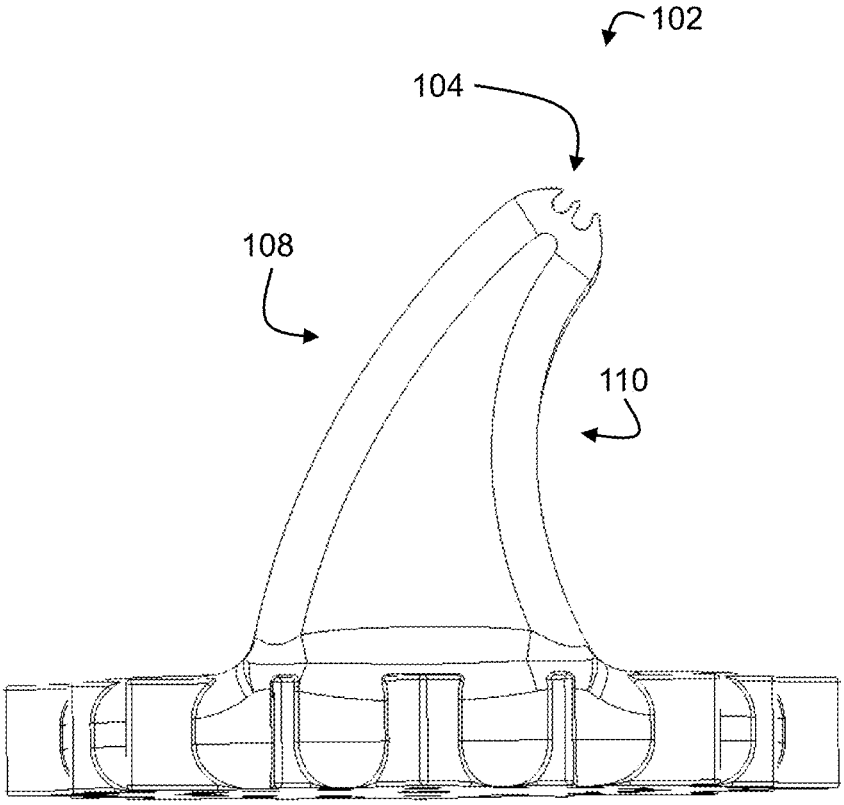
Figure 4H:
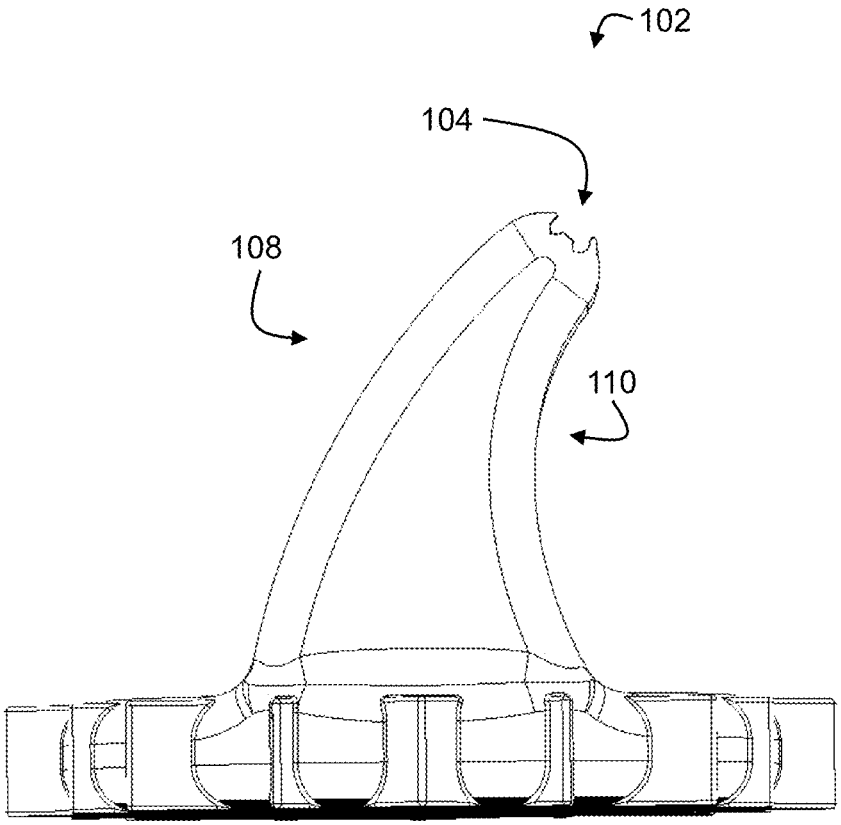
Figure 4I:
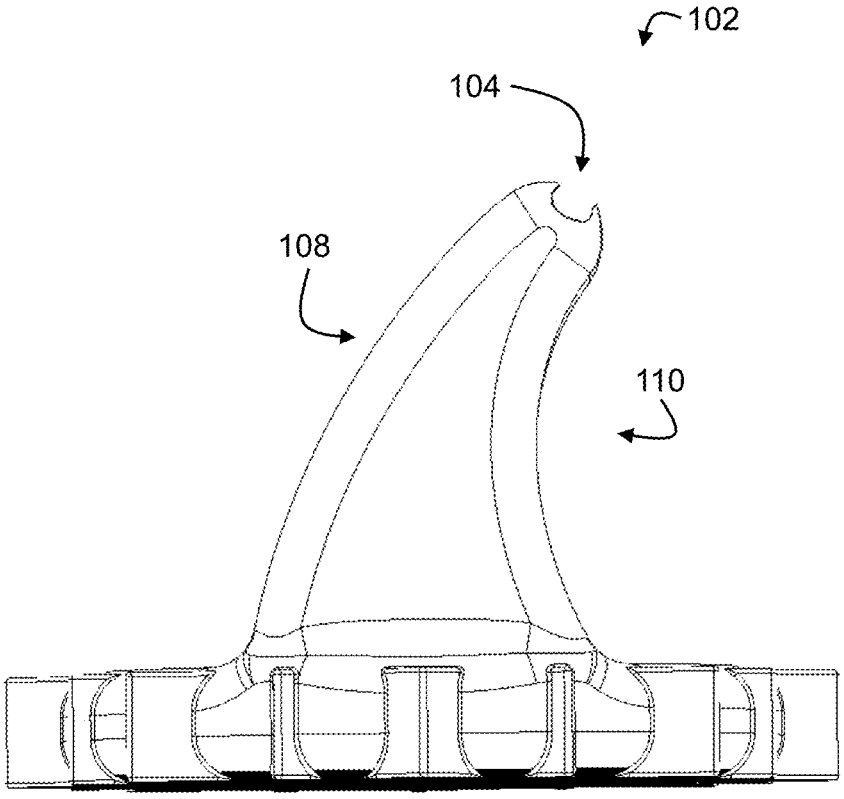

In some embodiments as shown in FIGS. 4G-4I, the top side 104 of the blade 102 may include additional curvatures and/or elements. For example, the top side 104 of the blade 102 depicted in FIG. 4G includes three mini-blades that may include all of the details disclosed herein regarding a standard sized blade 102. As shown, and upper mini-blade and a lower mini-blade may be opposing about a middle ridge. FIG. 4H depicts a similar structure with a smaller middle ridge, and FIG. 4I depicts a structure without a middle ridge. It is understood that these example tip forms are meant for demonstration and that the tip 104 may include any form. It also is understood that the tip 104 of a blade 102 is not limited in any way by its form.

In some embodiments, the tip 104 of a blade 102 may be removable and interchanged with a different tip 104. In this way, one tip 104 with a specific form and/or dimension may be interchanged with another tip 104 with a different form and/or dimension.

In some embodiments, the blade 102 comprises any suitable material(s) such as, without limitation, natural and/or synthetic rubber, plastic, wood, cork, metal, ceramic, stone, other materials, and any combination thereof. The blade 102 may be solid or hollow, and/or may include both solid portions and hollow portions.

In some embodiments, the top ridge 116 may comprise the same or different material and/or material characteristics as the body of the blade 102. For example, if the body of the blade 102 comprises a hard solid material, the top ridge 116 may include a top layer 120 (best seen in FIG. 3) that may comprise a softer layer such as silicon, rubber, or other type of polymer. In another example, if the body of the blade 102 comprises a softer material, the top ridge 116 may include a top layer 120 that may comprise a harder layer such as plastic, rubber, or other type of polymer. In some embodiments the layer 120 may range from 1.0 mm thick to 1.0 inch thick or more as desired.

In some embodiments, the top ridge 116 may be generally smooth while in other embodiments the top ridge 116 may include textures, bumps, notches, other surface characteristics and any combination thereof.

Figure 5:
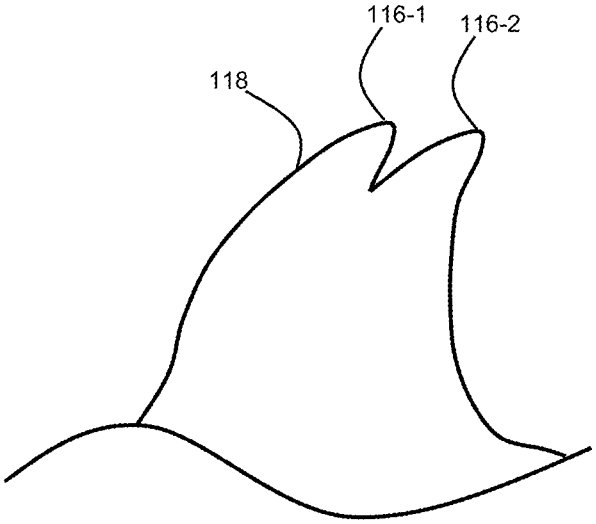

In one exemplary embodiment hereof, the top 104 may include two or more top ridges 116-1, 116-2, . . . **116-*n* (collectively and individually 116). An example blade 102 with two top ridges 116-1, 116-2 is shown in FIG. 5. In some embodiments, the top ridges 116 may be generally parallel with respect to one another (from the left 112 to the right 114), while in other embodiments the top ridges 116 may be at offset angles with respect to one another. In some embodiments, the top of the ridges 116 may be even with respect to one another and in other embodiments one or more of the top ridges 116 may extend higher or lower than other top ridges 116. In some embodiments, the widths of the top ridges 116 may be the same or similar and in other embodiments the widths of the top ridges 116 may differ with respect to one another (e.g., some top ridges 116** may be thicker or thinner than others).

In some embodiments, the top ridge(s) 116 may be generally linear from the left 112 to the right 114. In other embodiments, the top ridge(s) 116 may include curvatures. For example, in one embodiment, a top ridge 116 may be upwardly bowed from the left 112 to the right 114. In another example, a top ridge 116 may include steps, saw-tooth structures, or other structural characteristics from the left 112 to the right 114.

In some embodiments, the height of the blade 102 may measure 0.5-4.0 inches and preferably 2.0-3.0 inches. In some embodiments, the length (along the front 110 or back 108 from the left 112 to the right 114) may measure 1.0-6.0 inches and preferably 2.0-4.0 inches. In some embodiments, the width (along the left 112 or right 114 from the front 110 to the back 108) may measure 1.0-4.0 inches and preferably 1.0-2.0 inches. It is understood by a person of ordinary skill in the art that the dimensions may include other ranges and/or values as required by the tool 10 and by the body type and/or size of the patient, and that the scope of the tool 10 is not limited in any way by the dimensions of the blade(s) 102.

Figure 6:
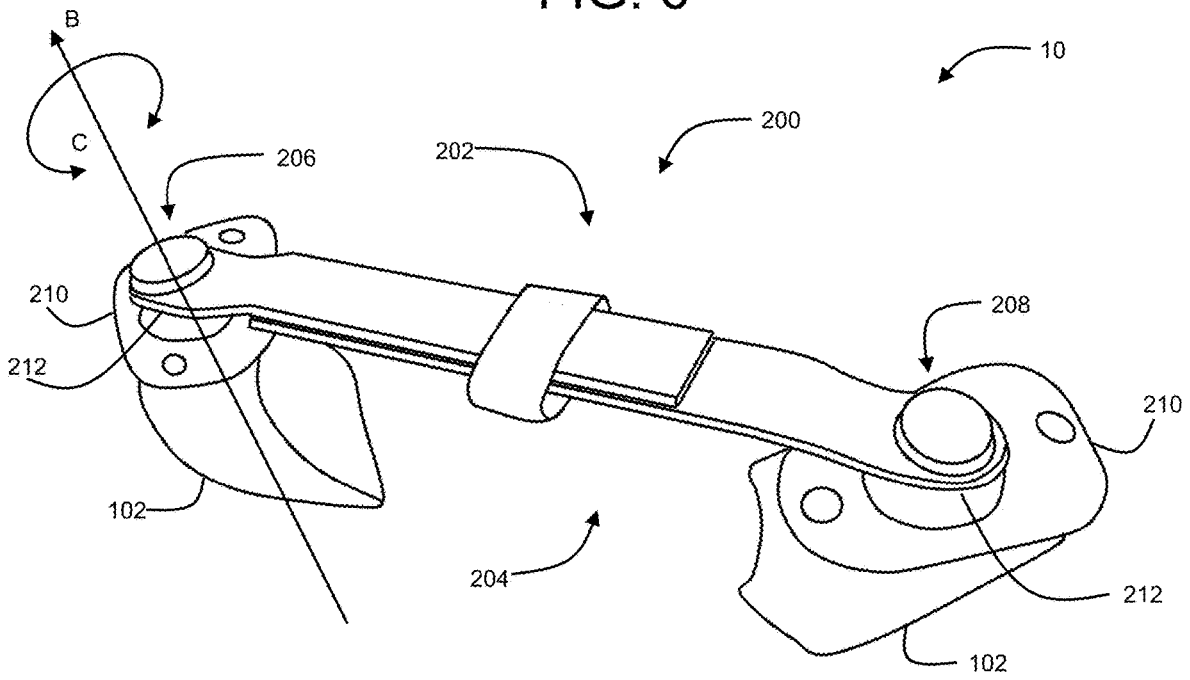
FIGS. 6-9 shows aspects of a massage device according to exemplary embodiments hereof.

In one exemplary embodiment hereof as shown in FIG. 6, the linkage assembly 200 comprises a central support structure 202 that extends between a first blade 102 (e.g., a left blade 102-L) and a second blade 102 (e.g., a right blade 102-R) thereby physically linking the first and second blades 102 together. In some embodiments, the left blade 102-L and the right blade 102-R are configured with the linkage assembly 200 so that the fronts 110 of each blade 102-L, 102-R may generally face towards one another (although not necessarily straight on and/or directly as shown). However, in other embodiments the blades are rotatable and may be positioned in any orientation with respect to one another.

In some embodiments, the support structure 202 may include a bar, rail, plate or other sufficient structure that extends between the blades 102-L, 102-R thereby connecting the blades 102-L, 102-R together. In some embodiments, the support structure 202 includes a body 204 with a left end 206 and a right end 208, the left and right ends 206, 208 each adapted to attach to a blade 102.

In one embodiment, the linkage assembly 200 includes a first blade base 210 (e.g., a left blade base 210-L) and a second blade base 210 (e.g., a right blade base 210-R), each blade base 210 adapted to attach to a respective left or right side 106, 108 of the support structure 202. Each blade base 210 also is adapted to attach to an associated blade 102, thereby attaching the associated blade 102 to the left or right side 106, 108 of the structure 202, respectively. In one implementation, the left blade 102-L is attached to the left blade base 210-L and the right blade 102-R is attached to the right base 210-R. In some embodiments the first and second blade bases 210 include plates or other types of support structures that may generally receive and attach to the bottom 106 of each respective blade 102. An example of this is shown in FIG. 6 with the device 10 upside-down and resting on its blades 102.

The size and shape of the blade bases 210 preferably generally corresponds to the size and shape of the bottom 106 of each corresponding blade 102, but other sized and shaped bases 210 may also be used. Each blade 102 may be attached to a corresponding blade base 210 using adhesive, screws, other types of attachment mechanisms and any combination thereof. In other embodiments, the left and right sides 206, 208 of the support structure 202 are attached directly to the bottoms 106 of each respective blade 102 using the same or similar attachment methods.

In one exemplary embodiment hereof, each blade base 210 is attached to its respective left or right side 206, 208 using a rotatable mount 212. In this way, each blade base 210 (and its associated blade 102) may rotate about its perpendicular axis (in the direction of arrow C about the axis B in FIG. 6). In some embodiments, the rotatable mount 212 may comprise a bolt that passes through an opening in a corresponding end 206, 208 inside which the bolt may rotate. In other embodiments, the rotatable mount 212 may include a bearing that is attached to a corresponding end 206, 208. In any event, the rotatable mount 212 may comprise any sufficiently rotatable-type mount that may allow an attached blade 102 and its associated base 210 to rotate about an axis perpendicular with respect to its associated plate 210.

Figure 7:
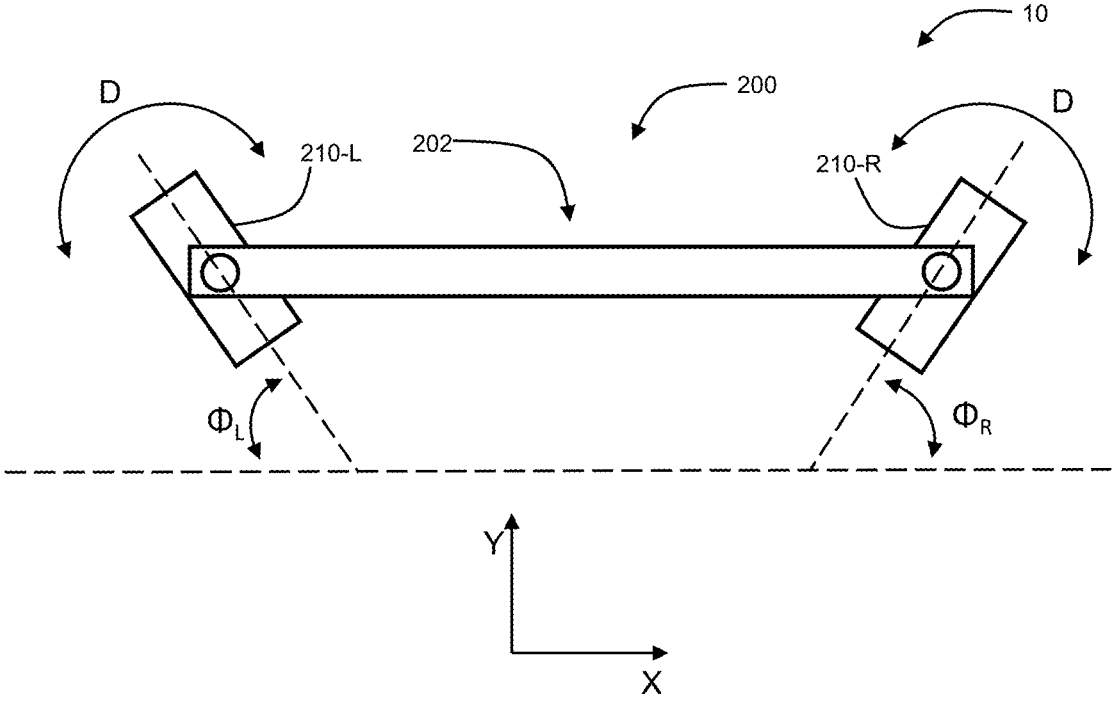

In some embodiments as shown in FIG. 7, the left blade base 210-L may be set to a particular rotational angle $\phi_L$ and/or the right blade base 210-R may be set to a particular rotational angle $\phi_R$, both with respect to the longitudinal axis of the support structure 202 (e.g., the X-axis as shown), and then locked in place. In one exemplary embodiment hereof, the angles $\phi_L$ and $\phi_R$ may be set to 40°-45°. In other embodiments, the angles $\phi_L$ and $\phi_R$ may be set to any angle, for example, at any angle ranging from 0°-90°. It is understood that the left and right blade bases 210-L, 210-R and associated blades 102-L, 102-R may be set to any rotational blade angle as required for the proper use of the tool 10.

In one example, the rotatable mount 212 comprises a bolt and nut combination, and the bolt may be loosened from the nut (e.g., using a thumb screw) so that the blade base 210 may be rotated to the desired angular position. The bolt may then be tightened to lock the base 210 in place. In another example, the rotatable mount 212 may include detents and notches and/or a ratchet element that may allow for the blade base 210 to be rotated when sufficient force is applied and subsequently held in place by the detents/notches and/or ratchet element when the tool 10 is in use. It is understood that the example rotatable mount 212 architectures described above are meant for demonstration and that the rotatable mount 212 may include any mechanism that may allow for the blade base 210 to be rotated to a desired angular position and then subsequently locked in place for use of the tool 10.

In some embodiments, the blade base 210, the rotatable mount 212 and/or the support structure 202 may include alignment and/or setting marks to facilitate the angular setting of the blade base 210 to a desired angular position. For example, the blade base 210 and/or the support structure 202 may include tick marks with corresponding angular settings (e.g., 40°, 45°, 50°, etc.) to facilitate the setting of the blade base 210 to a particular angle relative to the support structure 202. The angle setting of the blades 102 during use of the tool 10 will be described in other sections.

In some embodiments, one or both blade bases 210 may be generally rotationally fixed in place (not easily rotatable) and attached to the support structure 202 using a fixed mount. In this case, the one or fixed blade base(s) 210 and/or associated blade(s) 102 may be preset to a particular fixed angle or orientation with respect to the linkage assembly 200 (e.g., at 40°, 45°, 50°, etc.).

Figure 8:
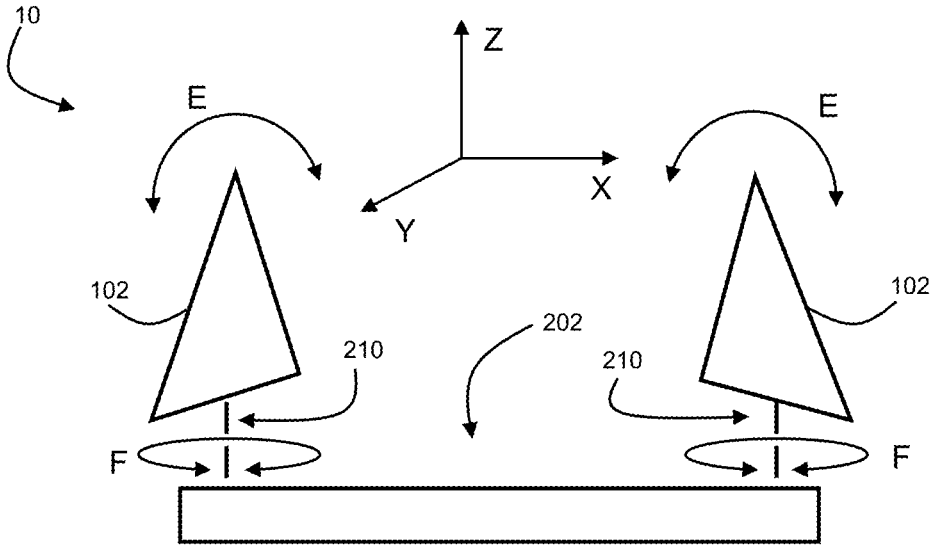

In one exemplary embodiment hereof as shown in FIG. 8, the rotatable mount 212 includes a ball joint or similar type of rotational mechanism that allows free rotation of the blades 102 and/or the blade bases 210 in two planes at the same time (e.g., as shown by arrows E and F).

Figure 9:
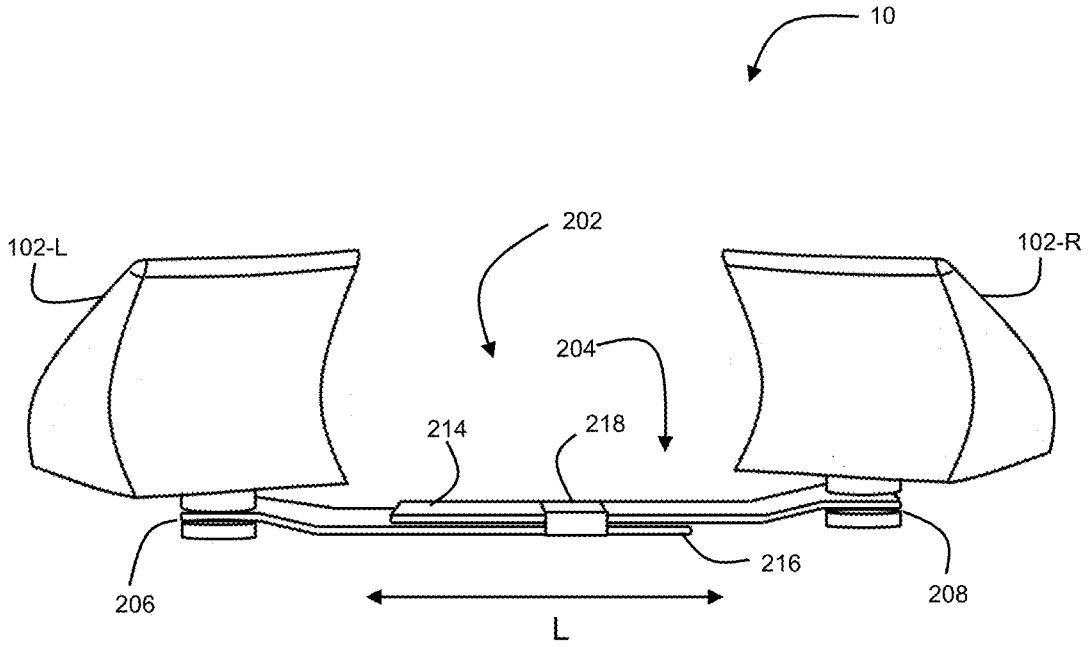

In one exemplary embodiment hereof, the length of the linkage assembly 200 and/or the support structure 202 is adjustable as shown in FIG. 9 and depicted by arrow L. In this way, the length of the linkage assembly 200 and/or the support structure 202 defines the separation distance between the two blades 102-L, 102-R, and the separation distance may be adjusted depending on the desired application of the tool 10 (as will be described in other sections). In one embodiment, the support structure 202 comprises a first section 214 and a second section 216 cascaded together to form the support structure 202. A portion of the first section 214 may overlap a portion of the second section 216 and the overlapping portions may be held together using a locking mechanism 218. As shown, the length of the portions of the sections 214, 216 that overlap may determine the overall length of the combined sections 214, 216 and thereby the length of the support structure 202. The locking mechanism 218 may include a clamp, a thumb screw, a bolt and nut, other types of locking mechanisms and any combination thereof. In addition, the first 214 and/or second section 216 may include slots, channels, grooves or other elements that may facilitate the parallel alignment of the sections 214, 216 and the easy movement of the sections 214, 216 with respect to one another.

In one embodiment, the locking mechanism 218 may be loosened and the length of the overlapping portions may be increased or shortened (e.g., by sliding the sections 214, 216 in or out with respect to one another) to increase or shorten the overall length of the support structure 202. Once the length of the support structure 202 is set to a desired length, the locking mechanism 218 may be tightened to lock the sections 214, 216 together in place and fix the support structure's length.

It is understood that the method by which the length of the support structure 202 is adjusted as described above is meant for demonstration and that the length of the support structure 202 may be adjusted using other methods, techniques and/or structure 202 architectures. For example, in some embodiments the support structure 202 may comprise telescopic cylinders, scissoring elements, and/or other types of expandable and/or retractable elements to facilitate the lengthening and/or the shortening of the support structure. In another example, in some embodiments the linkage assembly 200 (and/or the support structure 202) may include a plurality of openings on each end 206, 208 for attaching the blades 102 with the plurality of openings spaced apart by different distances. In any event, it is understood that the support structure 202 may comprise any design and/or any adequate elements that may allow for the distance between the first and second blades 102 to be adjusted as required by the use of the tool 10.

In some embodiments, the first section 214 and/or the second section 216 may include alignment and/or setting marks to facilitate the setting of the support structure 202 to a desired length. For example, the first section 214 and/or the second section 216 may include tick marks with corresponding length settings (e.g., 5", 6", 7", 8", 9", 10", 11", 12", 13", 14", etc.) to facilitate the setting of the support structure's length to a particular length depending on the patient's body size. This will be described in detail in other sections.

In some embodiments, the overall length of the support structure 202 may be fixed to a predetermined length (e.g., 5", 6", 7", 8", 9", 10", etc.) and may not be adjustable.

Figure 10:
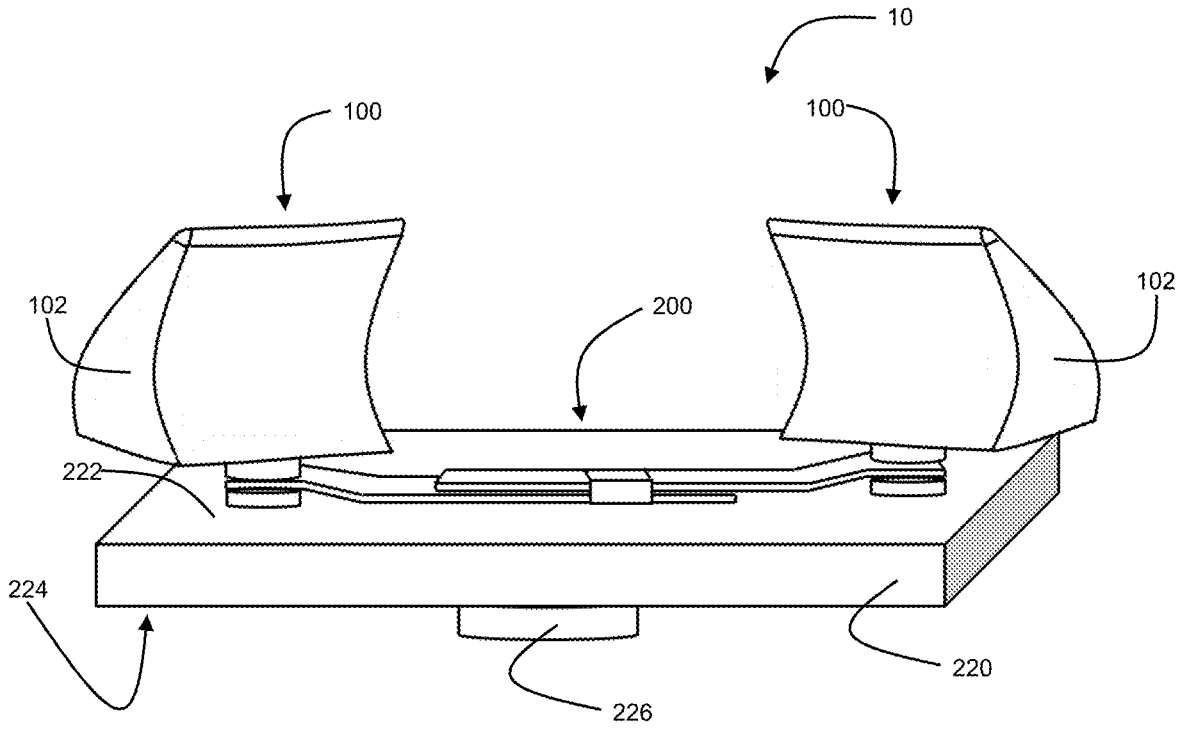
FIGS. 10-11 show aspects of a massage device support according to exemplary embodiments hereof.

In one embodiment, the tool 10 (e.g., the linkage assembly 200) includes a base 220 adapted to generally support the tool 10 when the tool 10 is in use. As shown in FIG. 10, the base 220 may include a top 222 (e.g., a top platform) with a footprint and attachment mechanisms that may receive and support the tool 10, and a bottom 224 with a sufficient footprint to provide lateral support to the tool 10 and to the user of the tool 10 during use. In some embodiments, the base 220 may include attachment mechanisms on the top 222 such as one or more recesses to receive a lower portion of the tool 10 (e.g., the lower portion of the support structure 202 and/or of the mounts 212), latches or clamps to secure the linkage assembly 200 to the base 220, other types of attachment mechanisms and any combination thereof.

In some embodiments, the base 220 may include a rotatable mount 226 (e.g., configured with its bottom 224) that may enable the base 220 to rotate and/or swivel/rock back and forth laterally to facilitate the massage action of the blades. In some embodiments, the base 220 may be independent from the support structure 202 and may be configured with the support structure 202 for use. In other embodiments, the base 220 may be integrated into the linkage assembly 200 (e.g., integrated with the support structure 202) and be provided as a single unit. In other embodiments, the base 220 may be used with an individual blade 102 to provide support to the blade 102.

Figure 11:
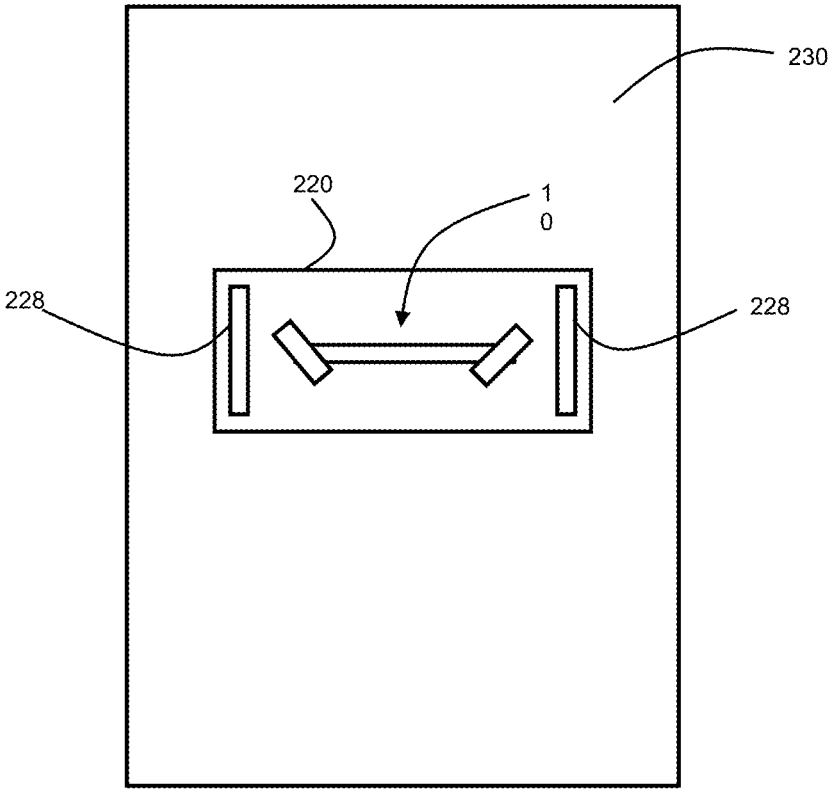

In one exemplary embodiment hereof as shown in FIG. 11, the tool 10 and/or the base 220 may be mounted vertically to be used in a standing position. For example, the base 220 may be mounted to a door 230 or other vertical structure using straps, bolts, latches, other types of attachment mechanisms and any combination thereof. In some embodiments, the base 220 may include handles 228 (e.g., one left handle and one right handle) on the left and/or right sides of the base 220 that the user may grasp and use to control his/her body position with respect to the tool 10 during use. The handles 228 may include any type of adequate handle design and may extend outward from the base 220, as necessary. For example, the handles may resemble "café racer" motorbike handles or any other types of handles.

In any event, the base 220 may include padding, handles or other features to facilitate the use of the tool 10 and to provide comfort and safety to the user. While the base 220 is depicted in FIG. 10 as generally rectangular, the base 220 may be any other shape such as circular, oval shaped, square, other shapes and any combination thereof. In some embodiments, the base 220 may include two or more portions (attached, unattached and any combination thereof) that may make up the base 220.

Figure 12:
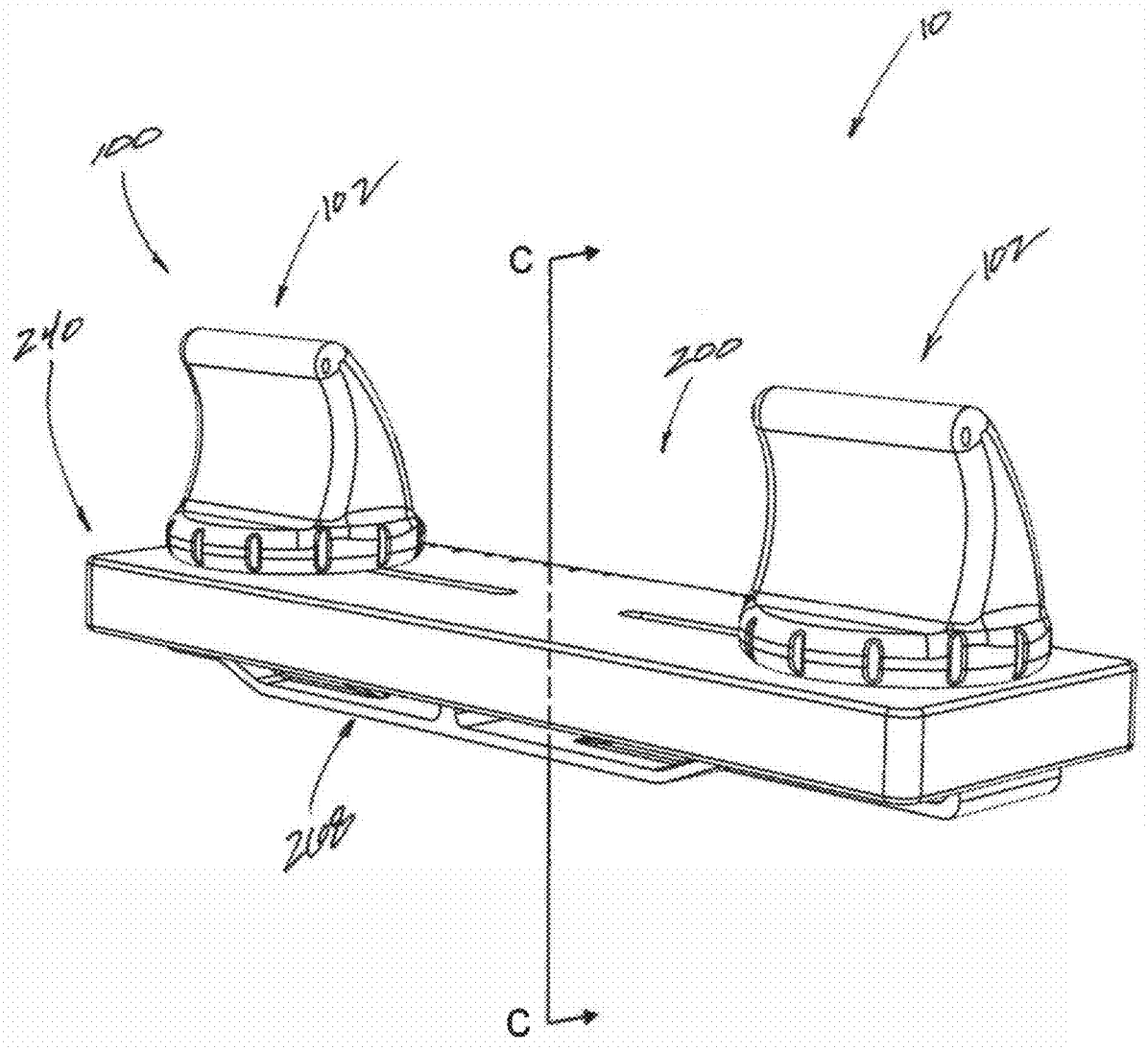
FIG. 12 shows a front pelvic schematic according to exemplary embodiments hereof.
Figure 12A:
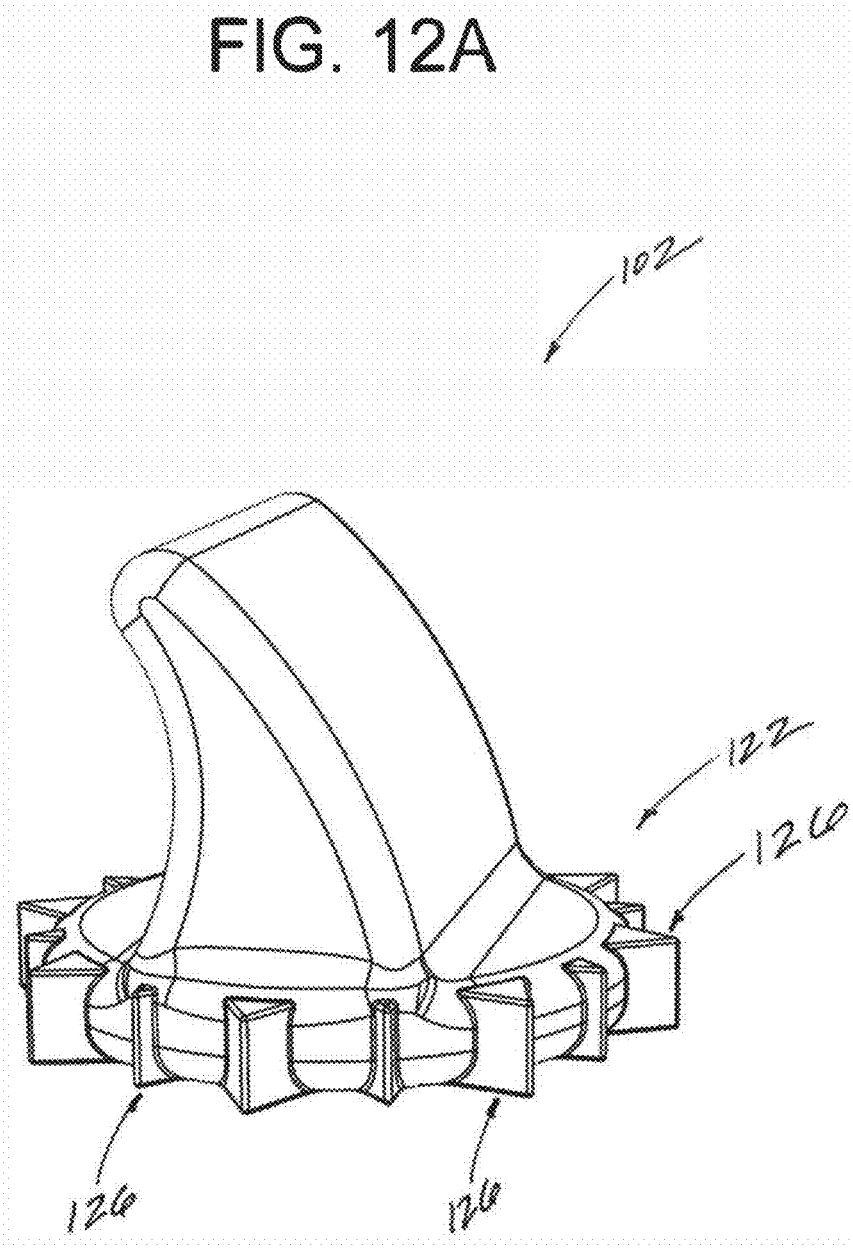
FIG. 12A shows aspects of a massage device blade according to exemplary embodiments hereof.
Figure 13:
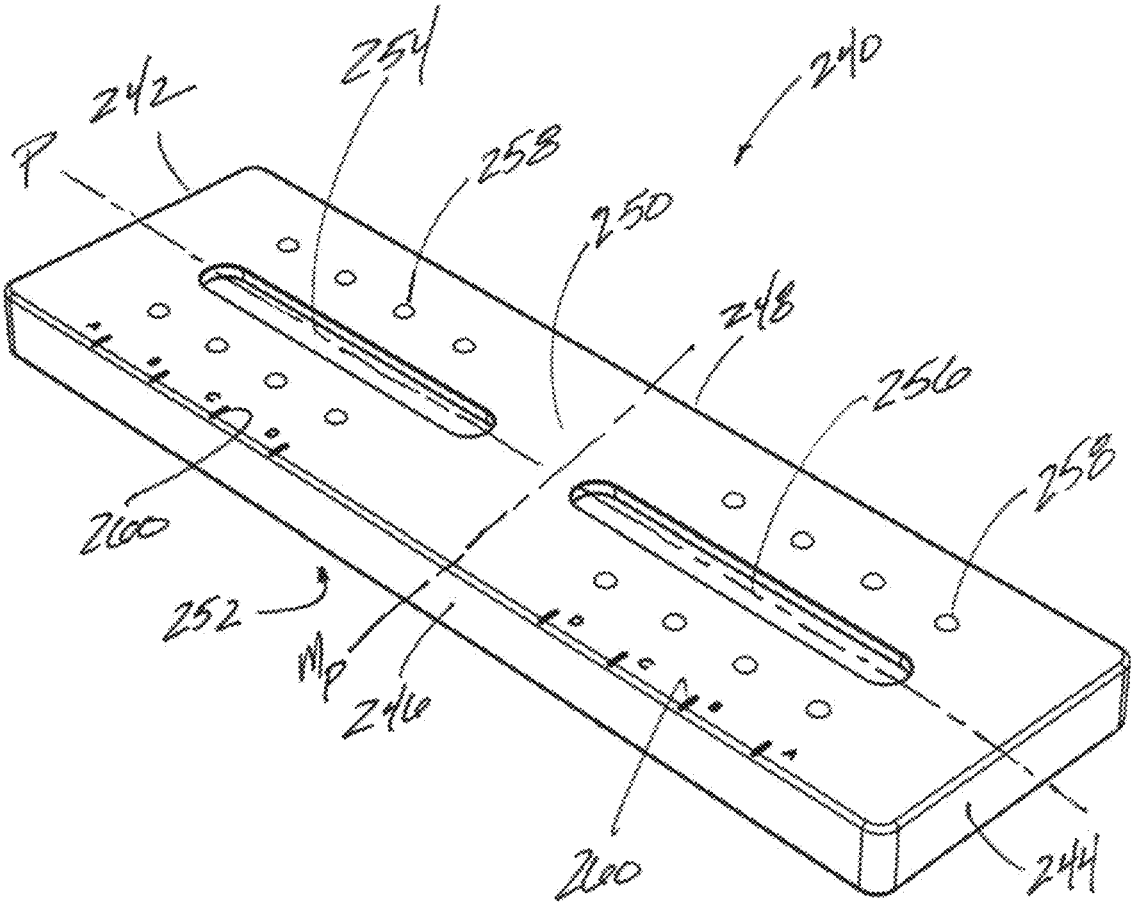
FIG. 13 shows aspects of a massage device base according to exemplary embodiments hereof.
Figure 14:
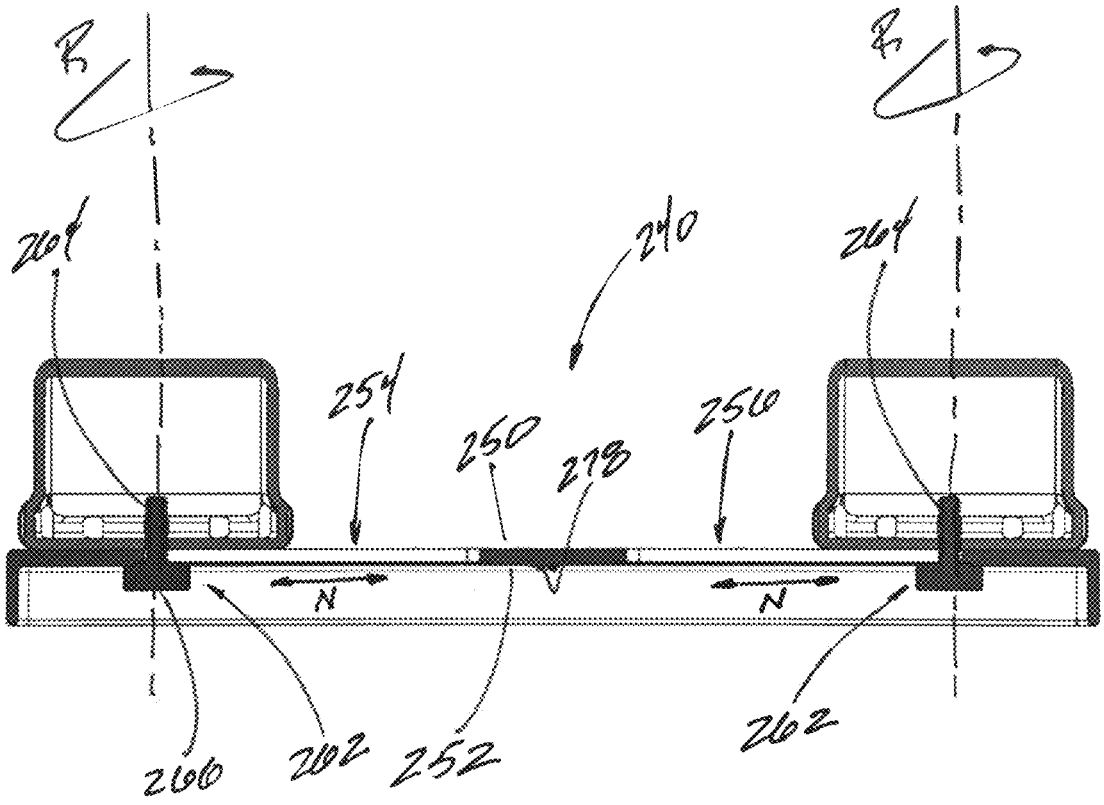
FIG. 14 shows aspects of a massage device according to exemplary embodiments hereof.

In some embodiments as shown in FIGS. 12-14, the device 10 includes a blade assembly 100 with blades 102 and a linkage assembly 200 including a base support 240. FIG. 12A shows a blade 102, FIG. 13 shows a schematic of the base support 240, and FIG. 14 depicts the device 10 taken from the perspective of cut-lines C-C of FIG. 12.

In some embodiments as shown in FIG. 12A, the blade 102 includes a blade base 122. The blade base 122 may be disk-shaped with an upper surface 124 that may be configured with and provide support to the blade 102. The blade base 122 may include outward extending circumferential setting elements 126 that may be used to align the blade 102 with corresponding setting marks 260 (described below) to set the blade 102 to desired lateral and/or rotational settings with respect to the blade support 240. In some embodiments as shown in FIG. 12A, the setting elements 122 may be arranged in symmetrical patterns such as, without limitation, a 16-point star (also referred to as a Vergina Star), an 8-point star, a 4-point star, stars with other numbers of points, and any combination thereof. It is understood that the setting elements 126 need not necessarily be arranged as star patterns, and that the elements 126 may include other types of elements such as notches, points, nubs, other types of setting elements and any combinations thereof that may be aligned with corresponding setting marks 260.

In some embodiments as shown in FIG. 13, the base support 240 includes a left side 242, a right side 244, a front 246, a back 248, a top side 250 and a bottom side 252. In some embodiments, the bottom side 252 may be hollow. While the base support 240 is depicted as generally rectangular in shape (e.g., a rectangular prism or cuboid), it is understood that the base support 240 may be formed in other shapes such as oval shaped, square, other shapes and any combinations thereof.

The base support's top side 250 may include a first slot 254 (also referred to as a channel) and a second slot 256 (also referred to as a channel). The channels or slots 254, 256 may be aligned along a longitudinal axis P extending from the left 242 to the right 244. In some embodiments, it may be preferable that the axis P bisect the base support 240 from the front 246 to the back 248 as shown, however, this may not be necessary. The first slot 254 is preferably located between the midpoint axis $M_P$ and the left side 242, and the second slot 256 is preferably located between the midpoint axis $M_P$ and the right side 244. While FIG. 13 shows the first and second slots 254, 256 as aligned with one another (e.g., along the axis P), it is understood that either of the slots 254, 256 may be offset towards the front 246 and/or the back 248.

In some embodiments, the slots 254, 256 pass from the top side 250 through a portion of the base support 240, but not all the way through the base support 240 to the bottom side 252. In other embodiments, the slots 254, 256 pass from the top of side 250 of the base support 240 completely through to the bottom side 252. As will be described in other sections, a first blade 102 may be configured with the base support 240 via the first slot 254 and a second blade 102 may be configured with the base support 240 via the second slot 256.

In some embodiments, the top side 250 includes one or more upward extending detents 258 adapted to engage corresponding notches on the underside of corresponding blades 102. In this way, the blades 102 may be movably held in place once set. In addition, the base support 240 may include one or more setting marks 260 that may be used to position the blades 102 at predetermined calibrated positions. This will be described in detail in other sections.

In some embodiments as shown in FIG. 14, the device 10 includes one or more locking members 262, each adapted to releasably secure a corresponding blade 102 to the base support's top side 250. In some embodiments, a first locking member 262 may pass from the underside 252 through the first slot 254 to the top side 250 and be configured with the bottom 106 of a corresponding blade 102. In one example, the locking member 262 includes a threaded post 264 extending upward from a base handle 266. The threaded post 264 may be received into a corresponding threaded opening in the bottom 106 of the blade 102 using a screwing motion, whereby the base handle 266 may be tightened against the base support's bottom side 252 to tighten the blade 102 to the support's top side 250. Accordingly, a blade 102 may first be positioned laterally along the slot 256 to a desired location setting (e.g., as represented by arrows N) and at a desired rotational setting (as represented by the arrows R), and then may be secured in place by tightening the locking member 262. A second locking member 262 may be used in a similar fashion via the second slot 256 to secure a second blade 102 to the base support 240.

In other embodiments, the locking member(s) 262 may include spring-loaded posts that may be adapted to releasably extend from the base handle 266 through the slot 254 and into the bottom 106 of a blade 102. In this example, the blade 102 may be held against the base support's top side 250 by the spring-loaded locking member 262 when at rest and may be released and moved along the slot 254 for repositioning by releasing the spring-loaded locking member 262. In some embodiments, the spring-loaded locking member 262 may be released by lifting up on the blade 102 and/or pulling down on the base handle 266 and/or by other techniques.

It is understood that a blade 102 may be configured with a corresponding slot 254 using other types of locking members 262 with other architectures as known in the art, and that the scope of the device 10 is not limited in scope in any way by the type of locking member(s) 262 that it may utilize. In any event, it is understood that each blade 102 may be releasably secured in place on the top surface 250 using a locking member 262 that may release the blade 102 for positional adjustment along a corresponding slot 254 (e.g., as represented by arrows N), and that may subsequently lock the blade 102 in place as desired.

Figure 15:
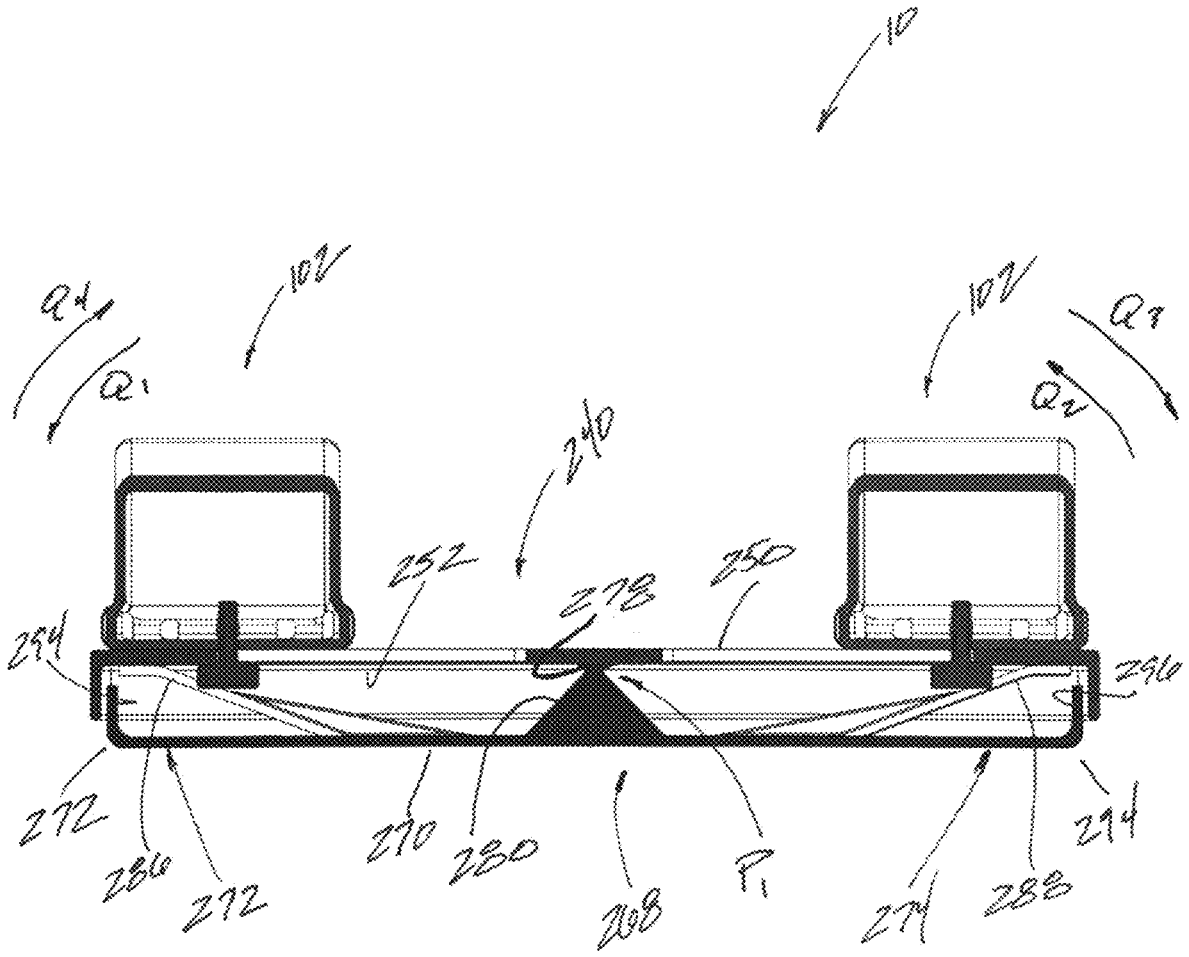
FIG. 15 shows aspects of a massage device according to exemplary embodiments hereof.
Figure 16:
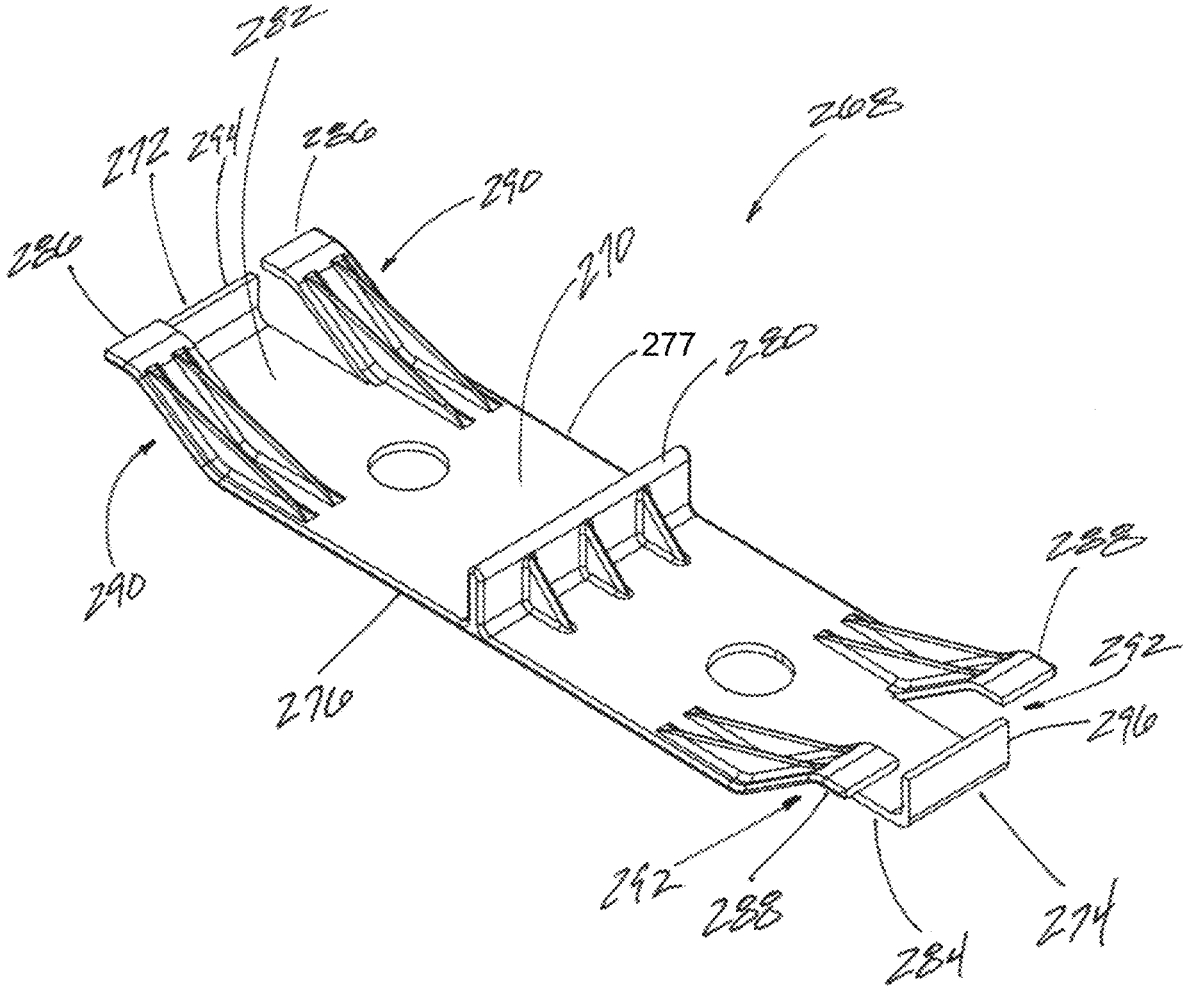
FIG. 16 shows aspects of a massage device rocker base according to exemplary embodiments hereof.

In some embodiments as shown in FIGS. 15-16, the base support 240 includes a rocking support 268 generally configured with its underside 252. When configured with the base support 240, the rocking support 268 enables the left and right sides 242, 244 of the base support 240 to pivot up-and-down about a pivot point $P_1$ as represented by the arrows $Q_1$, $Q_2$, $Q_3$, $Q_4$. When the left side 242 pivots downward in the direction of arrow $Q_1$, the right side 244 pivot upward in the direction of arrow $Q_2$, and when the right side 244 pivots downward in the direction of arrow $Q_3$, the left side pivots upward in the direction of arrow $Q_4$.

To support these motions, the rocking support 268 includes a lower base 270 including a left side 272, a right side 274, a front side 276, and a back side 277 and adapted to rest flat on a surface during use. The lower base 270 includes an upward extending pivot support structure 280 (e.g., a cross beam, wedge, or similar) located between its left and right sides 272, 274. The pivot support 280 is preferably located at a midpoint between the left 272 and the right 274 and extends across the base 270 from its front 276 to its back 277. The pivot support structure 276 is adapted to engage a pivot receptacle 278 (e.g., a notch as shown in FIG. 14) configured with the bottom side 252 of the base support 240. In this way, the pivot receptacle 278 acts as a fulcrum enabling the left and right sides 242, 244 of the base support 240 to pivot up and down with respect to the left and right sides 272, 274, respectively, as described above.

In some embodiments, the rocking support 268 includes a first spring member 282 configured on its left side 272 and a second spring member 284 configured on its right side 274. In some embodiments, the spring member 282 comprises an extension plate that extends laterally from the lower base 270 to the left side 272. The spring member 282 may be integral with the lower base 270 or may be separate piece. The spring member 282 preferably comprises an elastic material (e.g., spring steel, plastic, or any other suitable material(s)) that may deflect when a force is applied and that may return to its original shape when the force is removed.

The rocking support 268 also may include one or more side supports 286 configured on its left side 272 and one or more side supports 288 configured on its right side 274. In some embodiments, the left side supports 286 are positioned on opposite adjacent sides of the first spring member 282, and the right side supports 288 are positioned on opposite adjacent sides of the second spring member 284.

As shown in FIGS. 15 and 16, the left side supports 286 extend upward at an acute angle from a position between the pivot support structure 280 and the left side 272 to the left side 272. This may form an angular gap 290 beneath the left side supports 286 and the surface upon which the rocking support 268 may rest (e.g., the floor or massage table). Similarly, right side supports 288 extend upward at an acute angle from a position between the pivot support structure 280 and the right side 274 to the right side 274. This may form an angular gap 292 beneath the right side supports 288 and the surface upon which the rocking support 268 may rest.

When the rocking support 268 is configured beneath the base support 240 as shown in FIG. 15, the left side supports 286 may abut against the bottom side 252 of the base support 240 to the left thereby providing vertical support to the base support 240 in the area beneath the left blade 102, and the right side supports 288 may abut against the bottom side 252 of the base support 240 to the right thereby providing vertical support to the base support 240 in the area beneath the right blade 102. In addition, the pivot support structure 280 may engage the pivot receptacle 278 on the bottom side 252 of the base support 240 thereby providing vertical support to the base support in the middle region of the support 240.

In this configuration, a force applied to the left blade 102 may exert a downward force to the left side supports 286 causing the supports 286 to rotate downward into the angular gaps 290 as the spring member 282 may deflect upward. The base support 240, being pivotably engaged with the pivot support 280, may pivot downward to the left (arrow $Q_1$) and upward to the right (arrow $Q_2$) about the pivot point $P_1$. Subsequently, when the downward force to the left blade 102 is removed, the spring member 282 may return to its original shape and in doing so exert an upward force to the lower base 270 and to the left side supports 286 causing the base support 240 to return to its original horizontal position.

Similarly, a force applied to the right blade 102 may exert a downward force to the right side supports 288 causing the supports 288 to rotate downward into the angular gaps 292 as the spring member 284 may deflect upward. The base support 240, being pivotably engaged with the pivot support 280, may pivot downward to the right (arrow $Q_3$) and upward to the left (arrow $Q_4$) about the pivot point $P_1$. Subsequently, when the downward force to the right blade 102 is removed, the spring member 284 may return to its original shape and in doing so exert an upward force to the lower base 270 and to the right side supports 288 causing the base support 240 to return to its original horizontal position.

It can be seen that the result of this configuration forms a base support 240 that may be rocked in a seesaw motion by applying downward forces to the left and/or right blades 102.

In some embodiments, the first spring member 282 includes an upright stop 294 extending from its left side upward, and the second spring member 284 includes and upright stop 296 extending from its right side upward. In some embodiments, the upright stops 294, 296 may include upright plates, sections or extensions, upright posts or columns, any other suitable upright structures, and any combinations thereof. The upright stops 294, 296 may be integral to the spring members 282, 284, respectively, or may be separate parts coupled with the spring members 282, 284, respectively. As shown in FIG. 15, it may be preferable that when the base support 240 is at rest (no forces applied to either blade 102) the upright stops 294, 296 do not abut against the bottom 252 of the base support 240, but instead, provide a gap between each stop 294, 296 and the support's bottom 252. Accordingly, the height of each gap determines the amount of downward rotation available to the left and right side supports 286, 288, and the amount of upward deflection available to the first and second spring members 272, 274.

Figure 17:
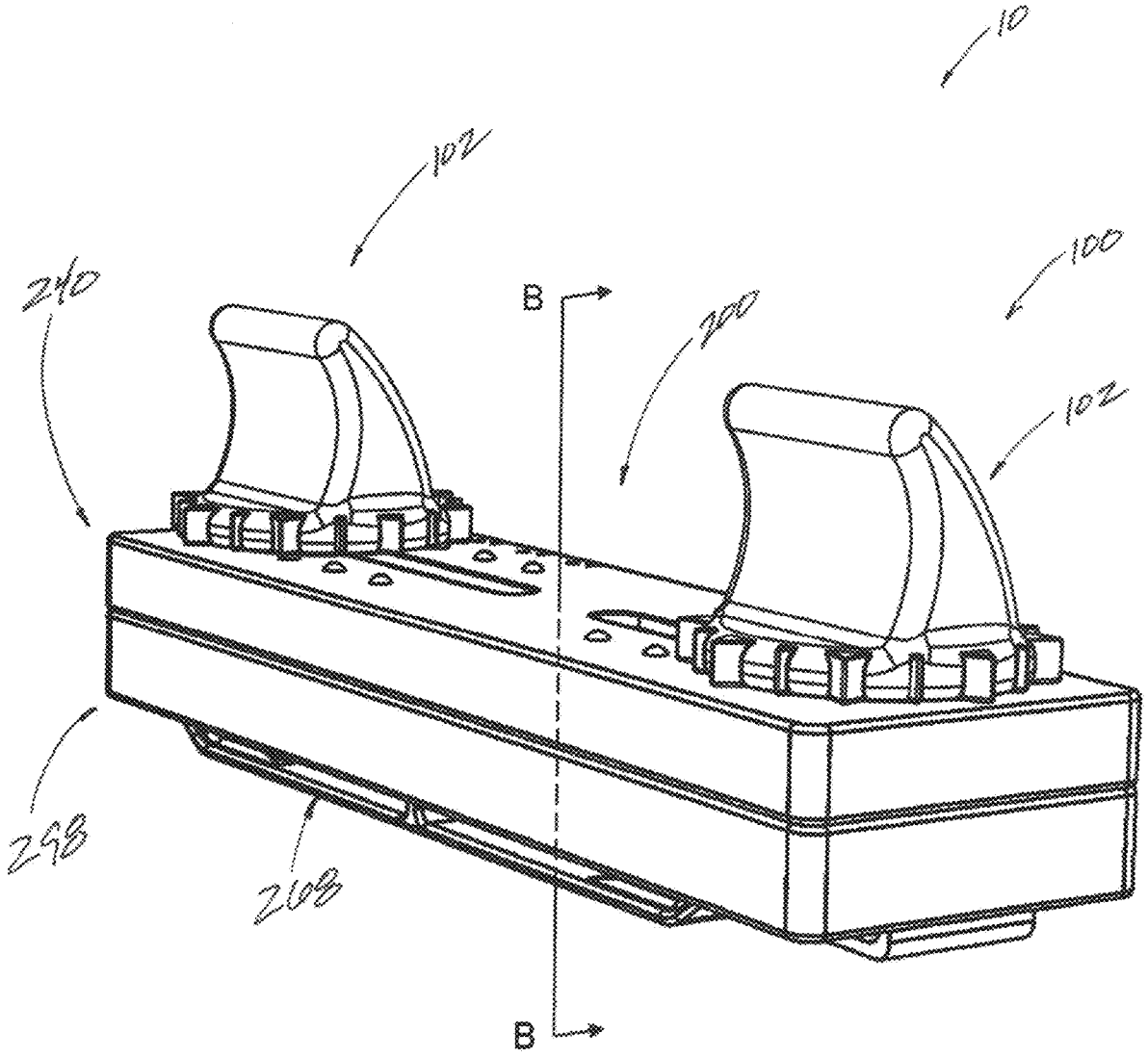
FIGS. 17-18 show aspects of a massage device according to exemplary embodiments hereof.
Figure 18:
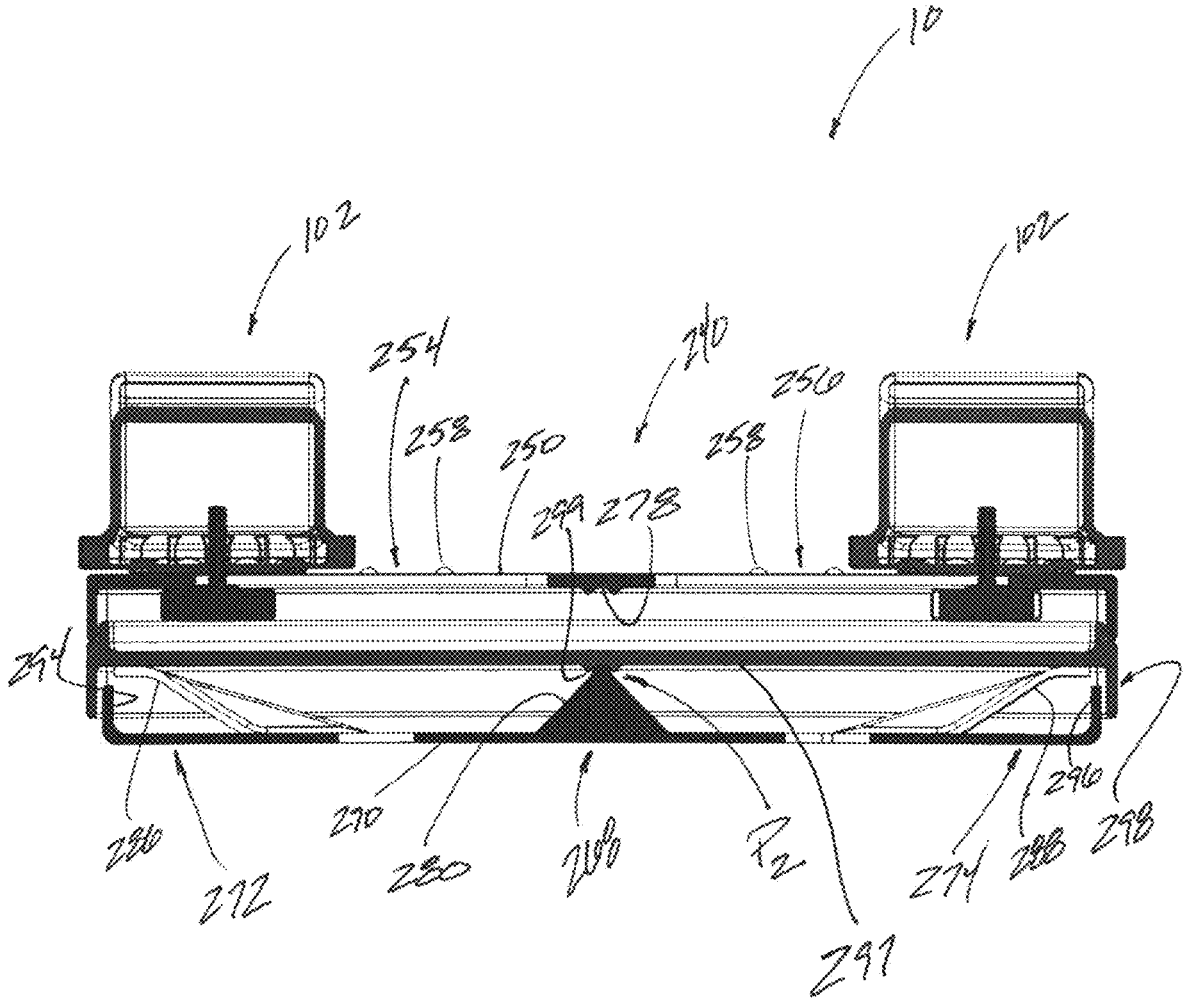

In some embodiments as shown in FIGS. 17-18, the linkage assembly 200 includes a spacer support 298 that may be configured with the bottom portion of the base support 240 to effectively extend the height of the overall linkage assembly 200 and of the tool 10. FIG. 18 depicts the device 10 taken from the perspective of cut-lines B-B of FIG. 17.

As shown, the spacer support 298 is configured with the bottom portion of the support base 240. It is preferable that the spacer support 298 generally provides elements similar to those of the base support 240 that facilitate and enable the base support 240 and the rocking support 268 to be coupled and to function as described above. For example, the spacer support may provide a second pivot receptacle 299 configured with its underneath surface 297 to provide a pivot point P2 for the pivot support 280 of the rocking support 268 to engage. In another example, the spacer support 298 may provide an underside surface 297 to the left upon which the rocker's left side supports 286 may abut against to provide vertical support to the base support 240 in the area beneath the left blade 102, and an underside surface 297 to the right upon which the rocker's right side supports 288 may abut against to provide vertical support to the base support 240 in the area beneath the right blade 102. It is understood that the spacer support 298 provides each element necessary for the base support 240 and the rocker support 268 to be configured on its opposing sides (e.g., the top side and the bottom side) for the resulting tool 10 to perform its functionalities as described herein. The spacer support 298 may include side notches (e.g., around its perimeter), detents lips, recesses, slots, or any other suitable mating elements that may enable the spacer support 298 to be configured between the base support 240 and the rocking support 268 and for the resulting device 10 to be functional.

Figure 19:
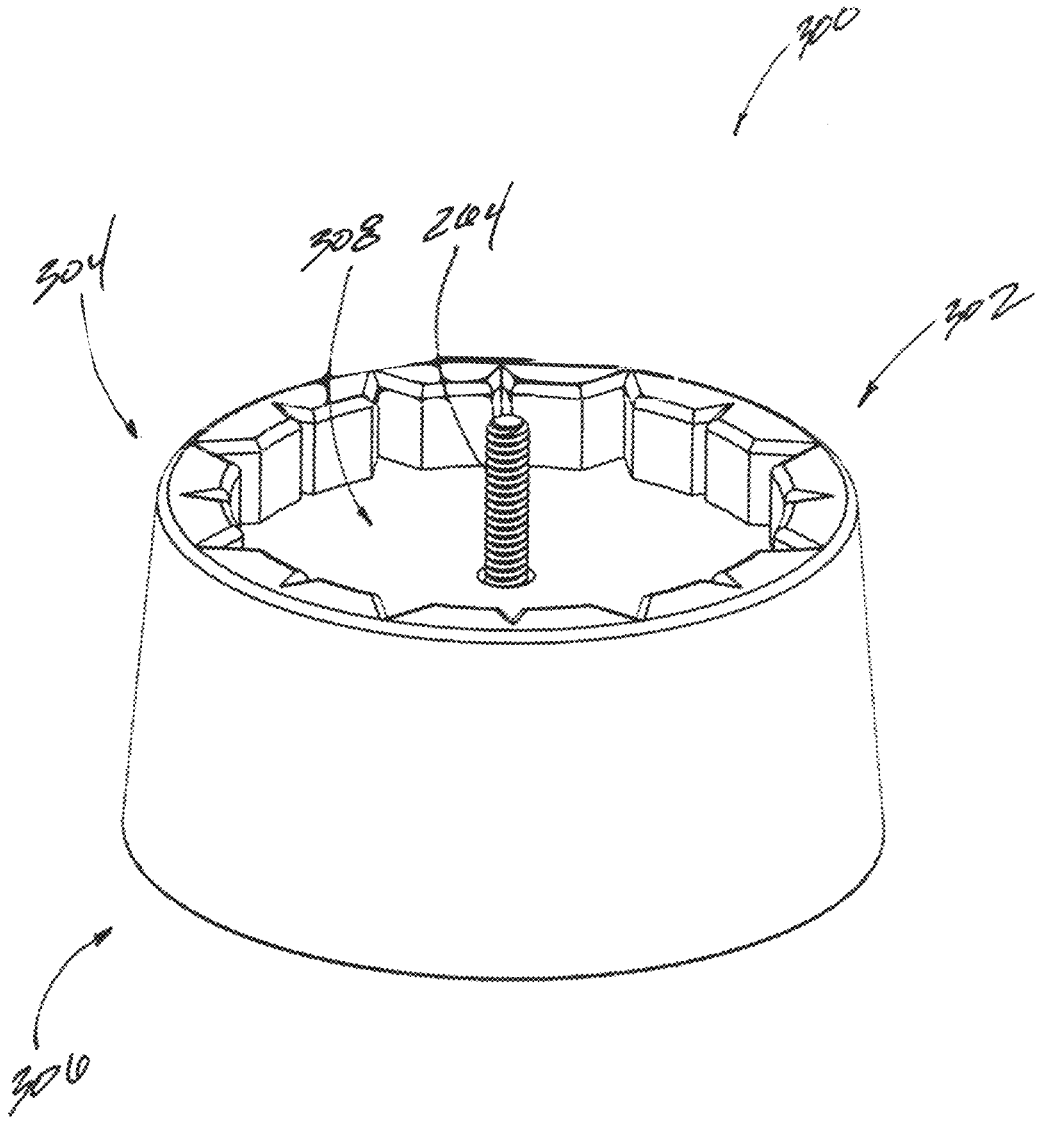
FIG. 19 shows aspects of a massage device blade base according to exemplary embodiments hereof.
Figure 20:
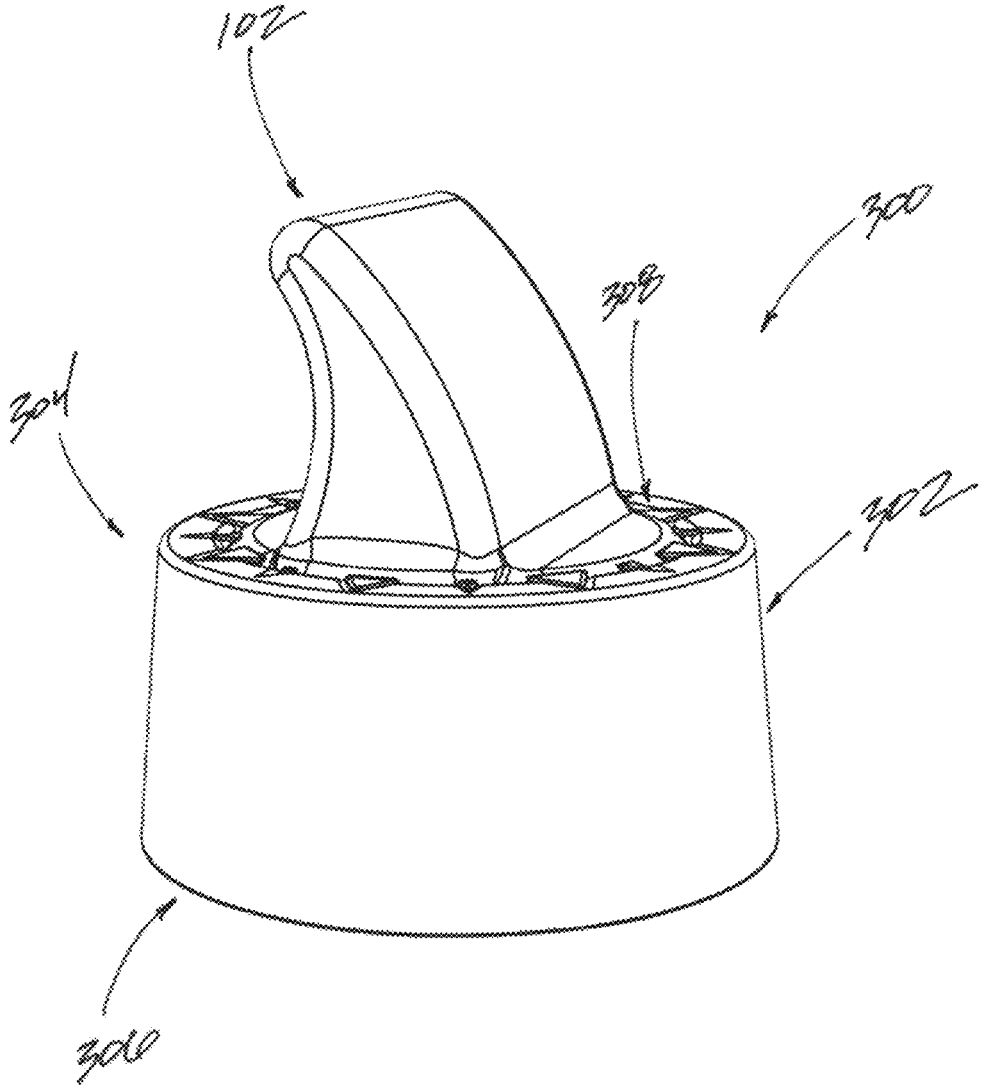
FIGS. 20-22 show aspects of a massage device blade and blade base according to exemplary embodiments hereof.

In some exemplary embodiments hereof as shown in FIGS. 19-22, the device 10 includes a single-blade support 300 (also referred to as a blade tower) adapted to receive and secure one blade 102 for use. In some embodiments, the single-blade support 300 includes a single-blade base 302 including an upper portion 304 and a bottom 306. The upper portion 304 includes a recess 308 adapted to receive and secure the blade's base 122, with the recess 308 generally including a shape that corresponds to the shape of the blade's base 126. For example, as shown in FIG. 19, the recess 308 includes a 16-point star shape that corresponds to the base's 16-point star shape shown in FIG. 12A. It is understood that other shapes may be used. FIG. 20 shows the base 122 of a blade 102 of FIG. 12A received and secured in the recess 308 of the blade tower 300.

In some embodiments, the bottom 306 of the tower's base 302 may be hollow to accommodate a locking member 262 to secure the blade 102. The locking member's base handle 300 may be positioned within the hollow bottom 306 with a threaded post 264 extending upward through an opening in the bottom of the recess 308. The blade 102 may include a corresponding threaded opening on its bottom 106 (e.g., in the bottom of the blade's base 122) whereby the base handle 266 may be rotated to screwably secure the blade 102 within the recess 308. The base 122 also may be secured using pressure fit, detents and notches, lips, other types of securing mechanisms and any combinations thereof.

With the blade 102 configured with the tower 300, the bottom 306 is adapted to rest on a surface (e.g., the ground, massage table, etc.) and to provide vertical and lateral support to the blade 102. Accordingly, the bottom 306 includes a suitably sized footprint and height to provide adequate support to the blade 102 to hold the blade 102 generally upright when in use.

Figure 21:
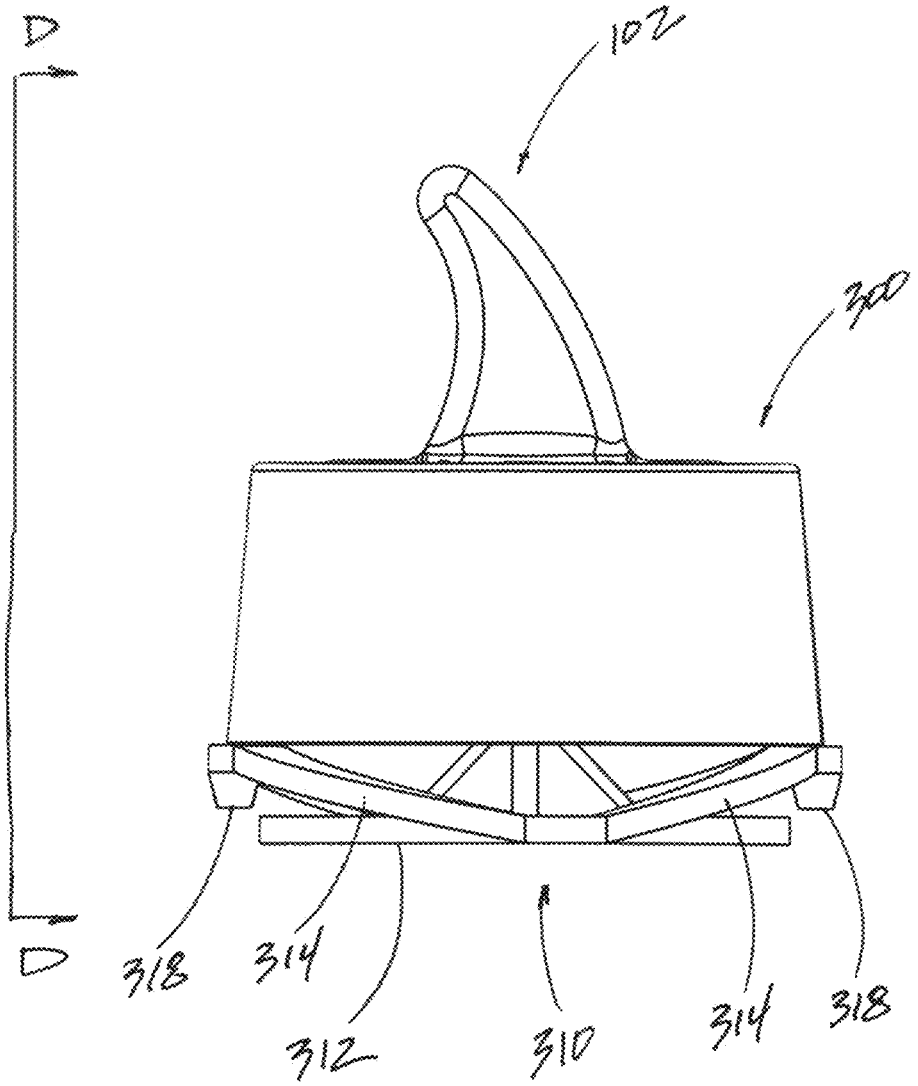
Figure 22:
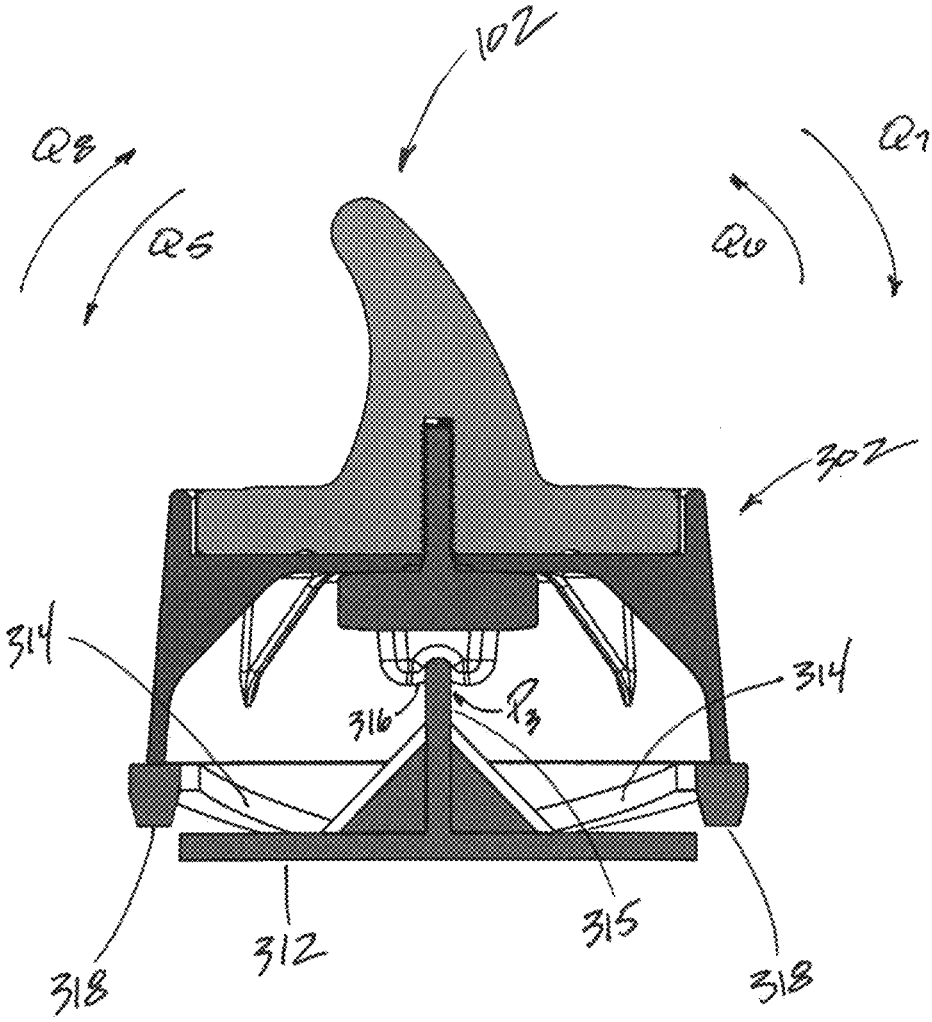

In some embodiments as shown in FIGS. 21-22, the blade tower 300 is configured with a rocking support 310. FIG. 22 shows a cutaway schematic taken from the perspective of the cutlines D-D of FIG. 21. The rocking support 310 may be configured with the bottom 306 of the base 302 and include a rocking base 312 adapted to rest on a surface (e.g., the floor, massage table, etc.) and one or more spring members 314 extending upward from the rocking base 312 to the tower's base 302. The rocking support 310 also may include a pivot support 315 (similar to pivot support 280 of FIG. 16). As shown in FIG. 22, the hollow bottom 306 of the base 302 may include a pivot receptacle 316 (e.g., a notch) that provides a pivot point P3 for the rocker base's pivot support 315. With the rocking support 310 configured with the tower's base 302 as shown, the base 302 may pivot up-and-down about a pivot point $P_3$ as represented by the arrows $Q_5$, $Q_5$, $Q_7$, $Q_8$. When the left side pivots downward in the direction of arrow $Q_5$, the right side pivots upward in the direction of arrow $Q_6$, and when the right side pivots downward in the direction of arrow $Q_7$, the left side pivots upward in the direction of arrow $Q_8$. In some embodiments, the rocking support 310 includes one or more stops 318 (e.g., configured with the spring members 314) adapted to abut the surface upon which the base 302 may rest at predefined pivot angles of the rocking support 310 during use.

It is understood that a blade 102 configured with a blade tower 300 may be used in any fashion as described herein in regards to any blade 102 configured with any other embodiment of the tool 10.

In Use

Figure 23:
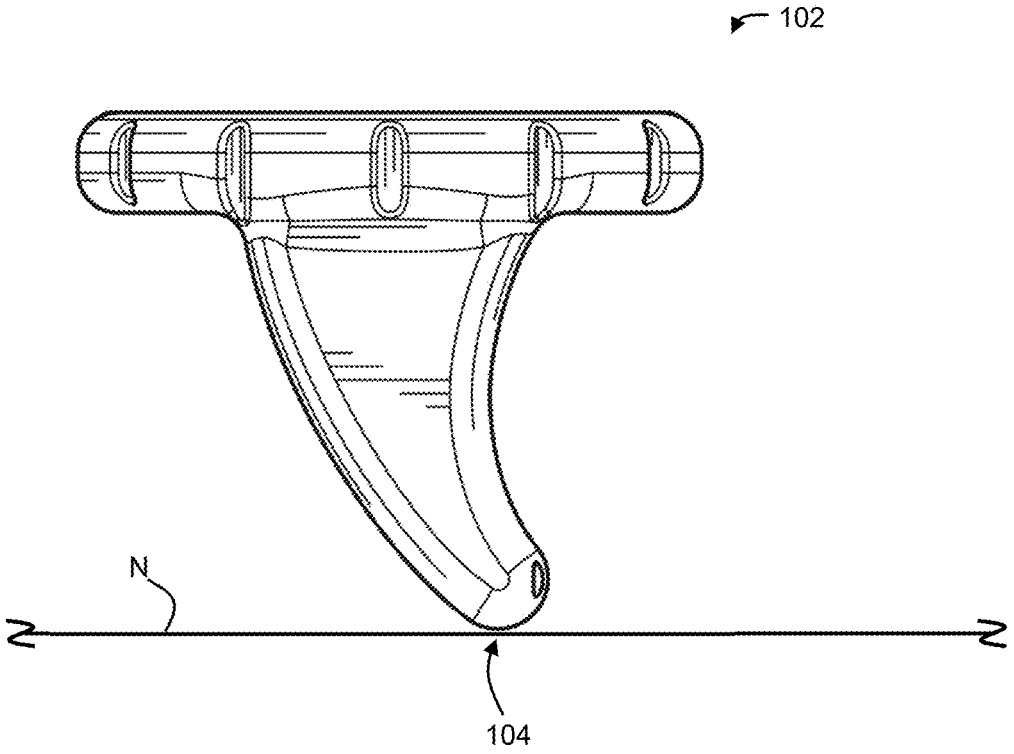
FIGS. 23-24 shows aspects of a massage device blade in use according to exemplary embodiments hereof.
Figure 24:
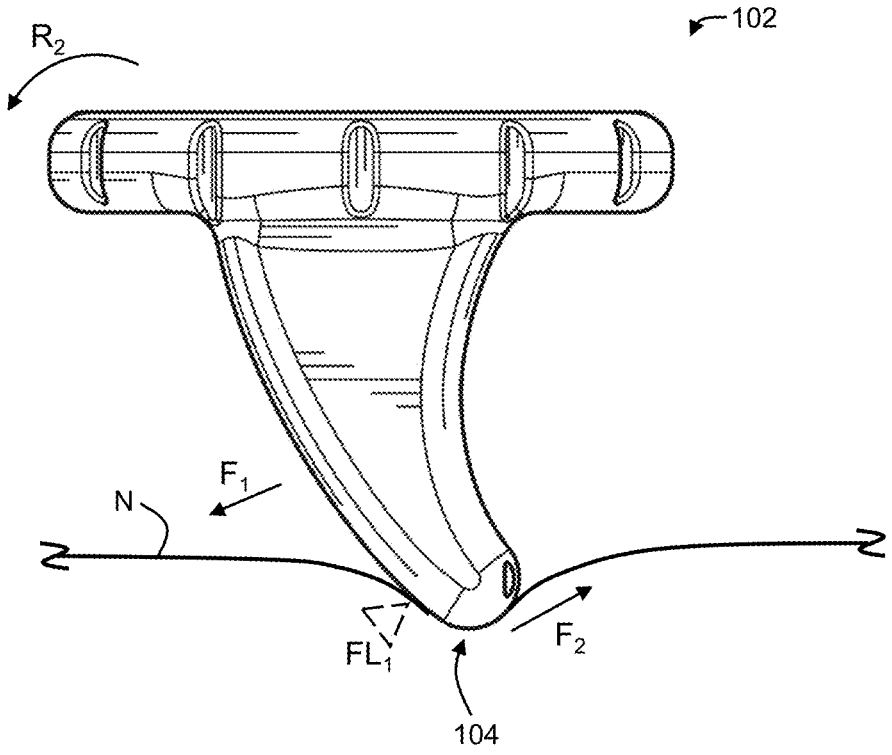

In one embodiment as shown in FIG. 23, the tips 104 one or more blades 102 of the tool 10 are placed in contact with the surface N of a massage recipient in preparation to perform a massage. While FIG. 23 depicts a single blade 102, it is understood that multiple blades 102 may be used similarly and simultaneously when the tool 10 may include multiple blades 102. As shown in FIG. 24, the blade 102 may then be pressed downward such that the blade's tip 104 presses against the recipient's skin causing a deformation in the skin and applying pressure to the muscles and/or bones (e.g., the ilium) beneath.

In this configuration, the blade 102 may act as a lever (and therefore may be referred to as a lever) as the tool 10 is rotated in the directions of the arrow R2. For example, a force $F_1$ applied to the tool 10 during a rocking motion in the direction of arrow R1 may set up a fulcrum $FL_1$ between the blade 102 and the recipient's skin N (and the muscles and/or bones beneath the skin N that provide support to the fulcrum $FL_1$) creating a resultant lever force $F_2$ applied by the tip 104 of the blade 102 to the recipient's muscles beneath the surface of his/her skin N. In some embodiments, the tip 104 may act as a wedge as it is pressed into the recipient's muscles. An analogy of this motion may include how the sharpened tip of a shovel is first pressed into the ground and then rotated backward about a fulcrum created between the back of the shovel and the ground to move the scooped soil upward.

Accordingly, the lever force $F_2$ applied to the recipient's underlying muscles provides a rolling curved penetration of the blade's tip 104 to the recipient's underlying muscles thereby providing the cross-fiber friction necessary to break down scar tissue adhesions and to lengthen the peripheral nerves in the area.

Figure 25:
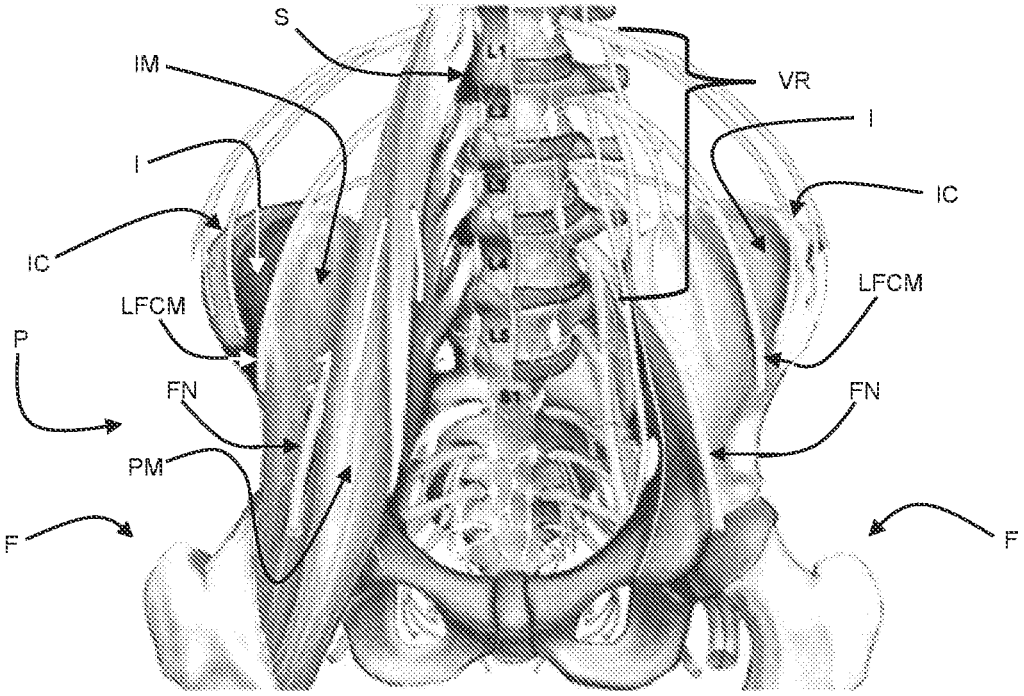
FIG. 25 shows a front pelvic schematic according to exemplary embodiments hereof.

FIG. 25 shows a schematic of the frontal pelvic region of a human body detailing the skeletal, muscular and nerve elements of the region. In general, the femur (F) (thigh bone) joins the pelvis (P) (made up of the ilium (I), the pubis (pubic bone) and the ischium) from below, and the spine (S) joins the pelvis (P) from above. The psoas muscle (PM) generally connects the lumbar vertebrae (e.g., L1, L2, L3, L4) of the spine (S) to the femur (F), and the iliacus muscle (IM) generally connects the pelvic bowl (e.g., the ilium (I)) to the femur (F). The ventral rami (VR) (including the anterior rami) emerges from the spinal cord at the lumbar vertebrae L1, L2, L3, and L4 to form the lumbar plexus.

The femoral nerve (FM) extends from dorsal divisions of the ventral rami of the second, third, and fourth lumbar nerves (L2, L3, and L4) downward and into the thigh region where it lies in a groove between the iliacus muscle (IM) and psoas major (P) muscles. From there, the femoral nerve (FM) further extends down the legs and into the feet.

The lateral femoral cutaneous nerve (LFCM) extends from dorsal divisions of the ventral rami of the second and third lumbar nerves (L2 and L3) where it emerges at the lateral edge of the psoas major (PM) muscles and then passes beneath the iliac muscle (IM) fascia. From there, the lateral femoral cutaneous nerve (LFCM) further extends down the legs into thigh, where it divides into anterior and posterior branches.

If the ventral rami (VR) and/or the femoral nerve (FM) are contracted involuntarily (e.g., due to injury), it may compact the adjacent muscles (e.g., the iliacus muscle (IM) and/or the psoas muscle (PM)) which may, in turn, compact and/or compress the bone joints that the muscles (IM), (PM) may be connected to. For example, a contraction of the femoral nerve (FM) may cause the psoas muscle (PM) to compact and/or compress the lumbar vertebrae (e.g., L1, L2, L3, L4) of the spine (S), and both the psoas muscle (PM) and the iliacus muscle (IM) to compact bone joints within the leg (e.g., hip, knee, ankle, etc.).

Figure 26:
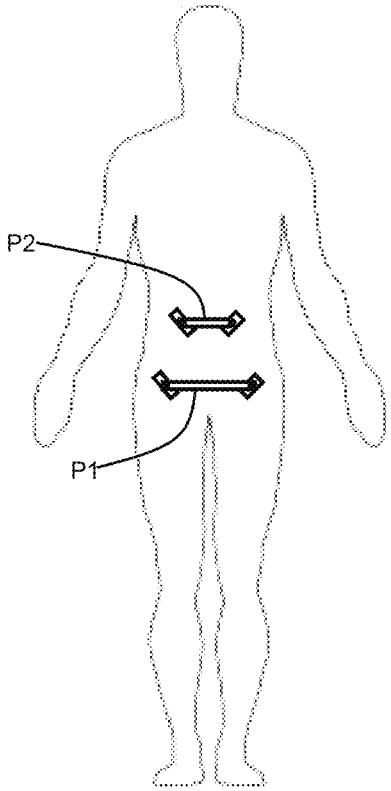
FIGS. 26-27 show aspects of the positioning of a massage device according to exemplary embodiments hereof.

In one exemplary embodiment hereof, the tool 10 is placed on a supportive surface (e.g., the floor) with the blades 102 facing upward. The patient may then lay on the tool 10 in a prone position so that the top ridges 116 of each blade 102 may press into the patient's abdomen. Alternatively, a massage therapist may assist the patient by helping to insert the tool with the patient lying supine. As shown in FIG. 26, the distance between the left and right blades 102-L, 102-R and the angle of each blade 102-L, 102-R may be adjusted as described above so that the top ridges of each blade 102-L, 102-R are aligned with the femoral nerve (FM) in the pelvic region (i.e., aligned with the femoral nerve (FM) in the groove between the iliacus muscle (IM) and psoas major (P) muscles). This is generally shown in FIG. 13 as P1.

Note that the curvature of the blades 102 (e.g., the surface 108) is contoured to follow the grades of the wings of the ilium bones on top of the iliacus muscles so that the top ridges 116 may apply cross-fiber pressure (e.g., when the tool is used in a rocking motion as described herein) to the psoas muscles and the femoral nerves at the correct angle range (e.g., preferably 40°-45° with respect to the X-axis).

Once in this position and with the tool 10 properly aligned in place (generally at P1), the patient may gently shift his/her weight from side-to-side, causing the top ridge 116 of each blade 102-L, 102-R to penetrate the psoas muscles (PM) on both the left and right sides, respectively. In this way, pressure may be placed by the top ridge 116 onto the femoral nerve (FM), gently lengthening it away from the spinal (S) and thereby reducing its contraction and the compaction of the muscles and related joints.

In addition, this action by the patient may cause the top ridge 116 of each blade 102 to penetrate the psoas muscles (PM) providing a cross-fiber friction upon the muscles (PM). Also, this action may cause the convex back surface 118 of the blade to project a deep tissue pressure upon the iliacus muscle (IM) and the lateral femoral cutaneous nerve.

In one exemplary embodiment hereof, the tool 10 may be moved to a second abdominal site as generally shown as P2 where the action of the tool 10 may be used to treat the ventral rami (VR) (including the anterior rami) in a similar fashion. Note that it may be preferable to shorten the length L of the linkage assembly 200 as shown to generally follow the contour of the psoas muscles closer to vertebrae higher in the abdomen.

Figure 27:
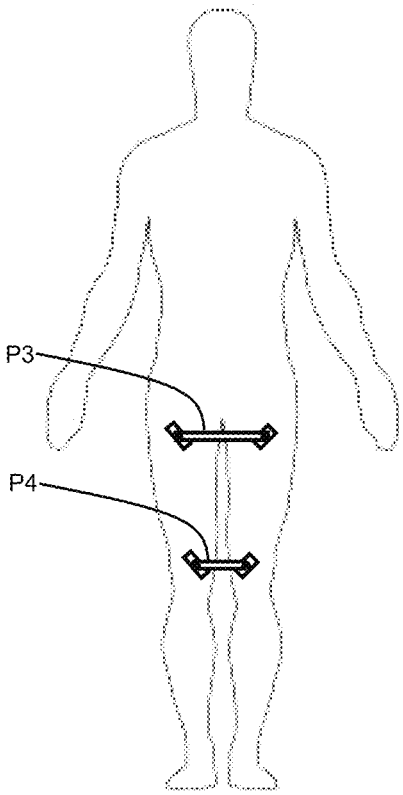

In one exemplary embodiment hereof as shown in FIG. 27, with the distance between the blades 102 and the angle of the blades 102 set, the tool 10 may be placed just below the hips (as generally represented as P3) and the side-to-side motion may be repeated to treat the psoas and iliacus muscles (PM), (IM) at their attachment to the left and right femur bones (F) in the upper leg region. In this position, direct pressure may also be applied to the femoral nerves (FN) and its branches in this region to lengthen the nerves (FN) thereby relaxing the associated nerves, muscles, and joints. In some implementations, the distance between the left and right blades 102-L, 102-R may not need to be adjusted between using the tool 10 in the pelvic region (as described above) and in the hip region. However, in some implementations the distance may be adjusted.

In one exemplary embodiment hereof as shown in FIG. 27, with the distance between the blades 102 and the angle of the blades 102 set, the tool 10 may be placed at any position between the hips and the knees (as generally represented as P4) to treat various muscles and/or nerves in this area. For example, the tool 10 may be positioned to treat the pectineus, adductor longus, sartorius, vastus *medialis*, rectus femoris, and/or other muscles and any combination thereof. In another example, the tool 10 may be positioned to treat the femoral nerve in this area, the anterior cutaneous branches of the femoral nerve, the saphenous nerve, and/or other nerves and any combination thereof.

In any of the above examples of use, the distance between the two blades 210-L, 210-R may be adjusted to different lengths (e.g., to different lengths L of the support structure 202) at any position for treatments of different or similar muscles and/or nerves. For example, the length L may be adjusted to a first length and used at the positions P1 and/or P2, and then adjusted to a second length and used at positions P1 and/or P2. In addition, the blades 210-L, 210-R may be set to any rotational setting with respect to one another.

While the description above describes the use of the tool 10 for the treatment of particular muscles and/or nerves at particular sites on the human body, it is understood that the particular muscles and/or nerves at the particular sites described above are meant for demonstration and that the tool 10 may be used to treat any applicable muscle and/or nerve at any site on or in the human body. It is also understood that the scope of the tool 10 is not limited in any way by the muscle(s) and/or nerve(s) that it may be used to treat.

It is understood by a person of ordinary skill in the art that any aspect and/or element of any embodiment(s) of the device 10 described herein may be combined in any way with any aspect and/or element of any other embodiment(s) of the device 10 to form additional embodiments of the device, all of which are within the scope of the device 10.

Those of ordinary skill in the art will appreciate and understand, upon reading this description, that embodiments hereof may provide different and/or other advantages, and that not all embodiments or implementations need have all advantages.

Where a process is described herein, those of ordinary skill in the art will appreciate that the process may operate without any user intervention. In another embodiment, the process includes some human intervention (e.g., a step is performed by or with the assistance of a human such as a massage therapists, physical therapists, etc.).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

What is claimed is:

1. A massage device comprising:

a first base including a base left side, a base right side and a base top side extending from the base left side to the base right side, the base top side including an intermediary point located between the base left side and the base right side;

a first lever comprising a first lever base and a first lever top side, the first lever base configured with the base top side and the first lever top side directed upward away from the base top side;

a second lever comprising a second lever base and a second lever top side, the second lever base configured with the base top side and the second lever top side directed upward away from the base top side;

a pivot point located on a surface opposite the base top side and below the intermediary point;

a rocker base configured beneath the first base and including a left spring mechanism configured to engage the base left side, a right spring mechanism configured to engage the base right side, and a pivot support configured to engage the pivot point, the rocker base supporting the first base entirely from below the base top side;

wherein a downward force applied to the base left side causes the left spring mechanism to apply an upward force to the base left side and wherein a downward force applied to the base right side causes the right spring mechanism to apply an upward force to the base right side; and wherein the left spring mechanism includes a first support arm extending at a first upward angle and adapted to engage the base bottom side toward the base left side, and/or the right spring mechanism includes a second support arm extending at a second upward angle and adapted to engage the base bottom side toward the base right side.

2. The massage device of claim 1 wherein the first lever top side extends linearly from a first lever top left side to a first lever top right side, and/or the second lever top side extends linearly from a second lever top left side to a second lever top right side.

3. The massage device of claim 1 wherein the first lever includes a first lever back surface extending from the first lever base to the first lever top side, and a first lever front surface extending from the first lever base to the first lever top side, the first lever back surface including a first convex up surface and the first lever front surface including a first concave down surface.

4. The massage device of claim 3 wherein the first lever back surface includes a decreasing slope from the first lever base to the first lever top side.

5. The massage device of claim 3 wherein the first lever front surface includes an increasing slope from the first lever base to an intermediate point between the first lever base and the first lever top side, and a decreasing negative slope, with respect to an axis perpendicular to the top side, from the intermediate point to the first lever top side.

6. The massage device of claim 3 wherein the first convex up surface is adapted to engage a first fulcrum established at a first contact point between the first convex up surface and a first portion of a recipient's body.

7. The massage device of claim 6 wherein the second lever includes a second lever back surface extending from the second lever base to the second lever top side, and a second lever front surface extending from the second lever base to the second lever top side, the second lever back surface including a second convex up surface and the second lever front surface including a second concave down surface, and wherein the second convex up surface is adapted to engage a second fulcrum established at a second contact point between the second convex up surface and a second portion of the recipient's body.

8. The massage device of claim 1 wherein the first and second levers are adapted to rotate about an axis perpendicular to the top side.

9. The massage device of claim 1 wherein the first lever and the second lever are opposing about the intermediary point of the base top side.

10. The massage device of claim 1 wherein the intermediary point is located halfway between the base left side and the base right side.

11. The massage device of claim 1 further comprising:

a first channel configured in the base top side and extending longitudinally from a location adjacent the base left side towards the intermediary point;

a second channel configured in the base top side and extending longitudinally from a location adjacent the base right side towards the intermediary point.

12. The massage device of claim 11 wherein the first lever base is configured to be longitudinally moveable along the first channel, and the second lever base is configured to be longitudinally moveable along the second channel.

13. The massage device of claim 12 further comprising a first locking mechanism configured to lock the first lever at a location along the first channel, and a second locking mechanism configured to lock the second lever at a location along the second channel.

14. The massage device of claim 11 wherein the first channel passes from the base top side to an underside surface of the base top side, and/or the second channel passes from the base top side to the underside surface of the base top side.

15. The massage device of claim 14 wherein the base top side includes at least one first lever indicator that indicates a first location of the first lever along the first channel and/or at least one second lever indicator that indicates a second location of the second lever along the second channel, and/or at least one third lever indicator that indicates a first rotational position of the first lever and/or at least one fourth lever indicator that indicates a second rotational position of the second lever.

16. The massage device of claim 1 wherein the left spring mechanism includes a first spring plate extending laterally from the pivot support in a first direction, and/or the right spring mechanism includes a second spring plate extending laterally from the pivot support in a second direction opposite the first direction.

17. The massage device of claim 16 wherein the first spring plate and/or the second spring plate is parallel to the base top side.

18. A massage device comprising:

a first base including a base left side, a base right side and a base top side extending from the base left side to the base right side, the base top side including an intermediary point located between the base left side and the base right side;

a first lever comprising a first lever base and a first lever top side, the first lever base configured with the base top side and the first lever top side directed upward away from the base top side;

a second lever comprising a second lever base and a second lever top side, the second lever base configured with the base top side and the second lever top side directed upward away from the base top side;

a pivot point located on a surface opposite the base top side and below the intermediary point;

a rocker base configured beneath the base top side and including a left spring mechanism configured to engage the base left side, a right spring mechanism configured to engage the base right side, and a pivot support configured to engage the pivot point, the rocker base supporting the first base entirely from below the base top side;

wherein a downward force applied to the base left side causes the left spring mechanism to apply an upward force to the base left side and wherein a downward force applied to the base right side causes the right spring mechanism to apply an upward force to the base right side; and wherein the left spring mechanism includes a first spring plate extending laterally from the pivot support and parallel to the base top side in a first direction, and/or the right spring mechanism includes a second spring plate extending laterally from the pivot support and parallel to the base top side in a second direction opposite the first direction.

19. A massage device comprising:

a first base including a base left side, a base right side and a base top side extending from the base left side to the base right side, the base top side including an intermediary point located between the base left side and the base right side;

a first channel configured in the base top side and extending longitudinally from a location adjacent the base left side towards the intermediary point;

a second channel configured in the base top side and extending longitudinally from a location adjacent the base right side towards the intermediary point;

a first lever comprising a first lever base and a first lever top side, the first lever base configured with the base top side and longitudinally moveable along the first channel, and the first lever top side directed upward away from the base top side;

a second lever comprising a second lever base and a second lever top side, the second lever base configured with the base top side and longitudinally moveable along the second channel, and the second lever top side directed upward away from the base top side;

a first locking mechanism configured to lock the first lever at a location along the first channel;

a second locking mechanism configured to lock the second lever at a location along the second channel;

a pivot point located on an underneath surface of the base top side below the intermediary point; and a rocker base configured beneath the first base and including a left spring mechanism configured to engage the base left side, a right spring mechanism configured to engage the base right side, and a pivot support configured to engage the pivot point;

wherein a downward force applied to the base left side causes the base right side to rotate upward about the pivot point and wherein a downward force applied to the base right side causes the base left side to rotate upward about the pivot point.

* * * * *